US009490569B2

(12) United States Patent
Sekino

(10) Patent No.: US 9,490,569 B2
(45) Date of Patent: Nov. 8, 2016

(54) CONNECTOR

(71) Applicant: YAZAKI CORPORATION, Minato-ku, Tokyo (JP)

(72) Inventor: Tetsuya Sekino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/876,052

(22) Filed: Oct. 6, 2015

(65) Prior Publication Data

US 2016/0028180 A1 Jan. 28, 2016

(30) Foreign Application Priority Data

Apr. 15, 2013 (JP) ..... 2013-084600

(51) Int. Cl.

| | |
|---|---|
| ***H01R 13/627*** | (2006.01) |
| ***H01R 13/502*** | (2006.01) |
| ***H01R 13/639*** | (2006.01) |
| ***H01R 43/26*** | (2006.01) |
| *H01R 13/64* | (2006.01) |
| *H01R 13/506* | (2006.01) |

(52) U.S. Cl.

CPC ..... *H01R 13/502* (2013.01); *H01R 13/6273* (2013.01); *H01R 13/639* (2013.01); *H01R 43/26* (2013.01); *H01R 13/506* (2013.01); *H01R 13/64* (2013.01)

(58) Field of Classification Search

CPC ..... H01R 13/6272; H01R 13/6275; H01R 13/641; H01R 13/629; H01R 23/025; H01R 23/7005

USPC ..... 439/354, 374

See application file for complete search history.

(56) References Cited

U.S. PATENT DOCUMENTS

| | | | | |
|---|---|---|---|---|
| 6,296,508 | B1 * | 10/2001 | Kuwahara | H01R 13/6273 439/353 |
| 7,326,091 | B2 * | 2/2008 | Nania | H01R 13/6599 439/681 |
| 7,422,466 | B1 * | 9/2008 | Arai | H01R 13/5804 439/353 |
| 8,337,240 | B2 * | 12/2012 | Feldmeier | H01R 13/04 439/488 |

(Continued)

FOREIGN PATENT DOCUMENTS

| | | | |
|---|---|---|---|
| CN | 101689728 | A | 3/2010 |
| CN | 102916298 | A | 2/2013 |
| JP | S64-056161 | U | 4/1989 |
| JP | 2010-165483 | A | 7/2010 |

(Continued)

OTHER PUBLICATIONS

Chinese Official Action issued on Aug. 30, 2016 in the counterpart Chinese patent application.

*Primary Examiner* — Hien Vu
(74) *Attorney, Agent, or Firm* — Mots Law, PLLC

(57) ABSTRACT

A connector includes: a first connector constituent including a first terminal and a cylindrical part provided with a first locking part and a second locking part; a second connector constituent provided with a second terminal, a first locked part, and a second locked part; and a connector cover body including a first cylindrical part provided with a first abutment part, and a second cylindrical part provided with a second abutment part, the second cylindrical part constituting a locked-part holding part. When the connector cover body is moved closer to the first connector constituent from a state in which the second connector constituent is installed in the connector cover body, the second connector constituent is joined to the first connector constituent.

6 Claims, 14 Drawing Sheets

(56) References Cited

U.S. PATENT DOCUMENTS

| | | | |
|---|---|---|---|
| 2010/0003841 | A1 | 1/2010 | Metzler et al. |
| 2010/0178789 | A1 | 7/2010 | Ohmori et al. |
| 2010/0240242 | A1 | 9/2010 | Pfaffenbach |
| 2013/0035004 | A1 | 2/2013 | Ikeda et al. |

FOREIGN PATENT DOCUMENTS

| | | | |
|---|---|---|---|
| JP | 2010-536184 | A | 11/2010 |
| JP | 2014-143160 | A | 8/2014 |
| WO | 2009/076916 | A1 | 6/2009 |

* cited by examiner

CONNECTOR

CROSS REFERENCE TO RELATED APPLICATIONS

This application is a continuation of International Application No. PCT/JP2014/060288, filed Apr. 9, 2014, and based upon and claims the benefit of priority from Japanese Patent Application No. 2013-084600, filed Apr. 15, 2013, the entire contents of all of which are incorporated herein by reference.

TECHNICAL FIELD

The present application relates to a connector and more particularly, to a connector that accomplishes an electrical connection between terminals by engaging another connector constituent with a pair of connector forming bodies joined to each other.

BACKGROUND ART

There is known, as a first conventional example, a connector 501 illustrated in FIG. 13 (see US 2010/0003841 A1 (PTL 1)). The connector 501 of the first conventional example becomes costly since coaxially arranged contact components 503, 505, 507 are all exclusive parts. Additionally, when developing a structure which accomplishes fitting with a wire harness side connector by its rotation with use of a crimping terminal, it is necessary to construct the wire harness side connector by at least two components. Moreover, a sensor side connector is invisible during the fitting work since it is located on the bottom of a hollow cylinder, and therefore it is necessary to ensure the fitting on the side of contacts.

The connector 501 of the first conventional example becomes costly since the contact components 503, 505, 507 are "multi-contact" constructed as a measure against vibration. To sum up, the connector 501 of the first conventional example is complicated in structure and also hard to ensure the fitting, so that it becomes expensive.

Therefore, as a connector which would enable easy fitting between housing parts even if the counterpart side housing part could not be visualized so clearly and whose structure is simplified, there is proposed a connector 511 of a second conventional example, which is illustrated in FIG. 14 (see Japanese Patent Application No. 2013-075992 (PTL 2)).

The connector 511 of the second conventional example includes a wire harness side connector part 515 having a first housing part 513 in which female terminals (not illustrated) are disposed, and a sensor side connector part 521 having a second housing part 519 in which male terminals 517 are disposed. In the connector 511 of the second conventional example, the fitting is executed between the first housing part 513 and the second housing part 519 and, at a fitting completion position, the female terminals and the male terminals 517 are connected to each other.

In the connector 511 of the second conventional example, the first housing part 513 is adapted so as to be rotatable to a body part 523. Further, the first housing part 513 is provided with a guide rib part 525, while the second housing part 519 is provided with a guide rail face 527 which guides the guide rib part 525 so that the first housing part 513 and the second housing part 519 are brought into formal fitting rotational positions by a position previous to the time when the female terminals and the male terminals 517 start to come into contact with each other.

SUMMARY

In the connector 511 of the second conventional example, the female terminals in the first housing part 513 are joined to the male terminals 517 in the second housing part 519 when the first housing part 513 (the body part 523) has been installed in the second housing part 519. Nevertheless, there is a possibility that the joining between the second housing part 519 and the first housing part 513 (i.e. joining between the female terminals in the first housing part 513 and the male terminals 517 in the second housing part 519) is released due to vibration or the like.

In order to solve the above mentioned problem, therefore, an object of the present application is to provide a connector including: a first connector constituent including a first terminal and a locking part; and a second connector constituent including a second terminal and a locked part, the second terminal being joined to the first terminal when the second connector constituent is installed in the first connector constituent, wherein the joining state between the first connector constituent and the second connector constituent is not cancelled so easily under condition that the second connector constituent is installed in the first connector constituent, whereby the fitting between the first terminal and the second terminal can be ensured.

A connector device according to a first aspect of the present application includes: a first connector constituent including a first terminal and a cylindrical part provided with a first locking part and a second locking part; a second connector constituent provided with a second terminal, a first locked part and a second locked part; and a connector cover body including a first cylindrical part provided with a first abutment part and a second cylindrical part arranged inside the first cylindrical part and apart from the first cylindrical part, the second cylindrical part provided with a second abutment part and constituting a locked-part holding part. When approaching, from a condition that the second connector constituent is installed in the connector cover body while the first locked part and the second locked part abut on the first abutment part, the connector cover body to the first connector constituent, the first locked part is deformed by a reaction force received from the cylindrical part of the first connector constituent and then detached from the first abutment part, so that the first locked part is brought into a condition that the first locked part can abut on the second abutment part. Subsequently, by the reaction force received from the cylindrical part of the first connector constituent, the second locked part is deformed and then detached from the first abutment part, so that the second locked part is brought into a condition that the second locked part can abut on the second abutment part. Subsequently, the first locked part and the second locked part abut on the second abutment part. Subsequently, the first locked part and the second locked part are restored and detached from the second abutment part, so that the first locked part is locked to the first locking part, the second locked part is locked to the second locking part and the second terminal is joined to the first terminal. Subsequently, as the second cylindrical part of the connector cover body enters the insides of the cylindrical part of the first connector constituent, the first locked part being locked to the first locking part, and the second locked part being locked to the second locking part, the locked-part holding part maintains a condition that the first locked part is being locked to the first locking part while the second locked part is being locked to the second locking part.

A connector according to a second aspect of the present application includes: a first connector constituent including a first terminal and a cylindrical part provided with a first locking part and a second locking part; a second connector constituent provided with a second terminal, a first locked part and a second locked part; and a connector cover body including a first cylindrical part provided with a first abutment part and a second cylindrical part arranged inside the first cylindrical part and apart from the first cylindrical part, the second cylindrical part provided with a second abutment part and constituting a locked-part holding part. When approaching, from a condition that the second connector constituent is installed in the connector cover body while the first locked part and the second locked part abut on the first abutment part, the connector cover body to the first connector constituent, the first locked part is deformed by a reaction force received from the cylindrical part of the first connector constituent and then detached from the first abutment part, so that the first locked part is brought into a condition that the first locked part can abut on the second abutment part. Subsequently, by the reaction force received from the cylindrical part of the first connector constituent, the second locked part is deformed and then detached from the first abutment part. Subsequently, the first locked part abuts on the second abutment part. Subsequently, the first locked part and the second locked part are restored and detached from the second abutment part, so that the first locked part is locked to the first locking part, while the second locked part is locked to the second locking part and additionally, the second terminal is joined to the first terminal. Subsequently, as the second cylindrical part of the connector cover body enters the insides of the cylindrical part of the first connector constituent, the first locked part being locked to the first locking part, and the second locked part being locked to the second locking part, the locked-part holding part maintains a condition that the first locked part is being locked to the first locking part while the second locked part is being locked to the second locking part.

In the connector according to the first or second aspect of the present application, it may be constructed so that: the second connector constituent includes a cylindrical part whose outer diameter is somewhat smaller than an inner diameter of the cylindrical part of the first connector constituent; the first locked part includes a first elastic arm which is elongated so as to project from the outer circumference of the cylindrical part obliquely to a generatrix of the outer circumference of the cylindrical part; the second locked part includes a second elastic arm which is elongated so as to project from the outer circumference of the cylindrical part obliquely to the generatrix of the outer circumference of the cylindrical part; and a crossing angle of the first elastic arm to the generatrix of the outer circumference of the cylindrical part is larger than a crossing angle of the second elastic arm to the generatrix of the outer circumference of the cylindrical part.

In the connector according to the first or second aspect of the present application, it may be constructed so that: the first elastic arm includes a tip portion extending in parallel with a center axis of the cylindrical part of the second connector constituent; a distance between the center axis of the cylindrical part of the second connector constituent and an outer circumferential end of the tip portion of the first elastic arm and a distance between the center axis of the cylindrical part of the second connector constituent and an outer circumferential end of the tip portion of the second elastic arm are equal to each other; and in a state before approaching the connector cover body to the first connector constituent in a situation where the second connector constituent is installed in the connector cover body while the first locked part and the second locked part abut on the first abutment part, the outer circumferential end of the tip portion of the first elastic arm and the outer circumferential end of the tip portion of the second elastic arm abut on an inner wall of the first cylindrical part of the connector cover body.

With the first or second aspect of the present application, it is possible to provide a connector including: the first connector constituent including the first terminal and the locking part; and the second connector constituent including the second terminal and the locked part, the second terminal joined to the first terminal when the second connector constituent is installed in the first connector constituent, wherein the joining state between the first connector constituent and the second connector constituent is not cancelled so easily under condition that the second connector constituent is installed in the first connector constituent, whereby the fitting between the first terminal and the second terminal can be ensured.

DESCRIPTION OF EMBODIMENTS

Figure 1:
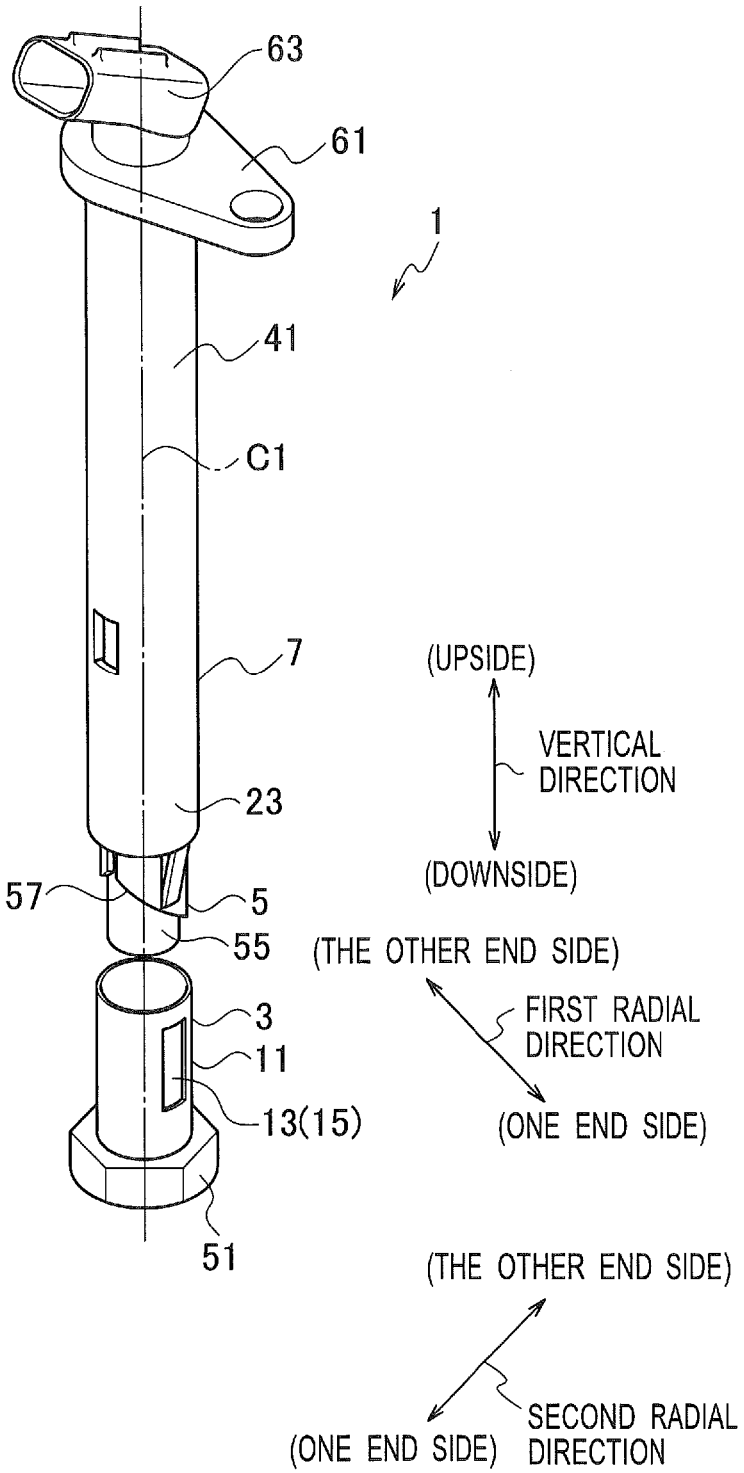
FIG. 1 is a perspective view of a connector according to an embodiment.

An embodiment of the present application will be described with reference to FIGS. 1 to 12. In use, a connector 1 according to the embodiment is installed in a casing of an equipment (for example, a cylinder head of an internal combustion engine such as a diesel engine) (not illustrated) integrally, and includes a first connector constituent 3, a second connector constituent 5, and a connector cover body 7.

The first connector constituent 3, such as a standby male connector, includes a first terminal 9 and a cylindrical part 11. The cylindrical part 11 is provided with a first locking part 13 and a second locking part 15. The first connector constituent 3 is installed in the casing of the equipment integrally.

In the first connector constituent 3, there is provided an ignition device (not illustrated), such as a glow plug such of a diesel engine. The first terminal 9 is composed of a plurality of male terminals. The first terminal 9 is electrically connected to the glow plug and the like.

The first connector constituent 3 may be provided with a sensor element, such as a combustion pressure sensor element, in place of the ignition device. Even if it is provided with a sensor element, the sensor element is connected to the first terminal 9 electrically.

The second connector constituent 5 is provided with a second terminal 17, a first locked part 19, and a second locked part 21. The second terminal 17 of the second connector constituent 5 is joined to the first terminal 9 when the second connector constituent 5 is installed in the first connector constituent 3.

The second connector constituent 5 is a female connector (for example, a female connector on the side of a glow plug). The second terminal 17 is composed of a plurality of female terminals.

Under condition that the second connector constituent 5 is installed in the first connector constituent 3, the respective male terminals constituting the first terminal 9 of the first connector constituent 3 and the respective female terminals constituting the second terminal 17 of the second connector constituent 5 are joined to each other.

The connector cover body 7 includes a first cylindrical part 23 and a second cylindrical part 25. The first cylindrical part 23 is provided with a first abutment part 27. The second cylindrical part 25 is arranged coaxially with the first cylindrical part 23. Inside of the first cylindrical part 23, the second cylindrical part 25 is apart from the first cylindrical part 23. The second cylindrical part 25 is provided with a second abutment part 29. The second cylindrical part 25 constitutes a locked-part holding part 31. Details of the locked-part holding part 31 will be described later.

The connector cover body 7 is, for example, a wire harness side male connector. The connector cover body 7 is provided with a third terminal 33. The third terminal 33 is composed of, for example, a plurality of male terminals.

The respective female terminals of the second terminal 17 and the respective male terminals of the third terminal 33 are electrically connected to each other through wires (not illustrated) having flexibility (wires extending through the insides of the second connector constituent 5 and the connector cover body 7). Therefore, the second connector constituent 5 and the connector cover body 7 are connected to each other by the wires having flexibility. The connector cover body 7 can change its position and posture with respect to the second connector constituent 5, with a certain degree of freedom (within a range permitted by wires having flexibility).

A wire harness (not illustrated) is connected to the third terminal 33. The connector cover body 7 is mounted to the second connector constituent 5 under condition of being installed in the first connector constituent 3. When the wire harness is connected to the third terminal 33, the first terminal 9 is electrically connected to the wire harness through the second terminal 17, the wires having flexibility, and the third terminal 33.

In the connector 1, when approaching the connector cover body 7, which is in a state (see FIG. 4) that the second connector constituent 5 is integrally installed in the connector cover body 7 while the first locked part 19 and the second locked part 21 abut on the first abutment part 27, toward the first connector constituent 3 in order to join the second terminal 17 to the first terminal 9, the joining between the first terminal 9 and the second terminal 17 will be accomplished according to the behavior as described below.

Note, the connector is adapted so that, when approaching the connector cover body 7 to the first connector constituent 3, the second connector constituent 5 is pushed by the connector cover body 7 since the first locked part 19 and the second locked part 21 abut on the first abutment part 27, and consequently not only the connector cover body 7 but also the second connector constituent 5 approaches to the first connector constituent 3. Further, by approaching the connector cover body 7 and the second connector constituent 5 to the first connector constituent 3, the second connector constituent 5 enters the inside of the cylindrical part 11 of the first connector constituent 3.

Figure 5:
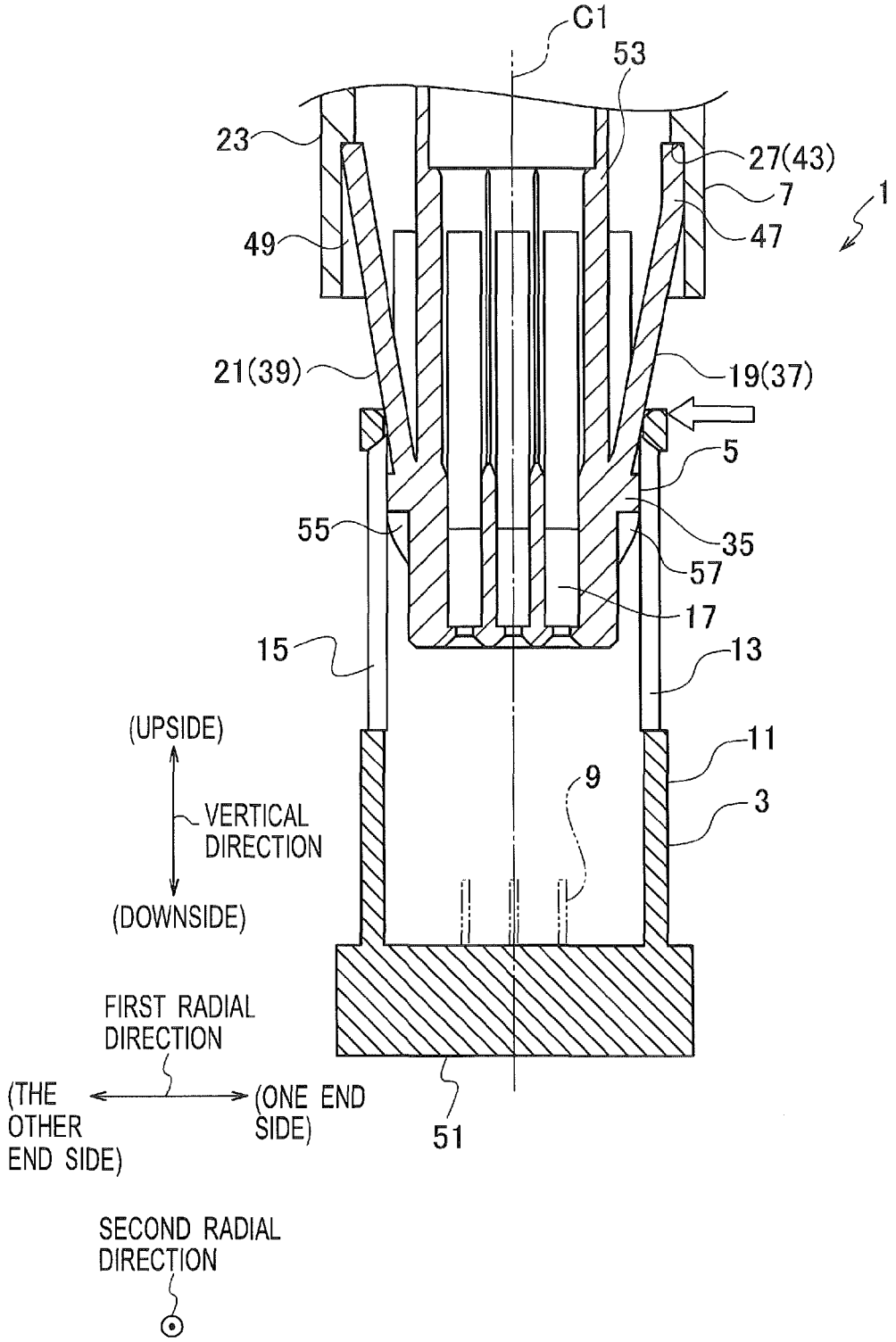
FIG. 5 is a view illustrating a situation in the course of installing the second connector constituent and the connector cover body into the first connector constituent, in the connector according to the embodiment.

First, while keeping a state in which the second locked part is abutting on the first abutment part 27, it is carried out to make the first locked part 19 abut on the cylindrical part 11 of the first connector constituent 3 (see FIG. 5). Then, by a reaction force received from the cylindrical part 11 of the first connector constituent 3 (the opening of the cylindrical part 11), the first locked part 19 is elastically deformed and detached from the first abutment part 27, so that it becomes possible for the first locked part 19 to abut on the second abutment part 29 (see FIGS. 6 and 8).

In connection, even if the first locked part 19 is deformed and detached from the first abutment part 27, the second locked part 21 still abuts on the first abutment part 27 and therefore, when approaching the connector cover body 7 to the first connector constituent 3, the second connector constituent 5 is pushed closer to the first connector constituent 3 by the connector cover body 7.

Successively, while keeping the state in which the first locked part 19 is capable of abutting on the second abutment part 29 as a result of being elastically deformed and detached from the first abutment part 27 by the reaction force received from the cylindrical part 11 of the first connector constituent 3, the second locked part 21 abuts on the cylindrical part 11 of the first connector constituent 3. Then, by the reaction force received from the cylindrical part 11 of the first connector constituent 3 (the opening of the cylindrical part 11), the second locked part 21 is elastically deformed and detached from the first abutment part 27, so that it becomes possible for the second locked part 21 to abut on the second abutment part 29 (see FIG. 7).

When approaching the connector cover body 7 to the first connector constituent 3 under the condition that the first locked part 19 and the second locked part 21 are deformed and detached from the first abutment part 27, the second connector constituent 5 is no longer pushed by the connector cover body 7, while only the connector cover body 7 approaches the first connector constituent 3.

Subsequently, the first locked part 19 and the second locked part 21 abut on the second abutment part 29 (see FIG. 8). When approaching the connector cover body 7 to the first connector constituent 3 in such a condition that the first locked part 19 and the second locked part 21 abut on the second abutment part 29, not only the connector cover body 7 but also the second connector constituent 5 approaches the first connector constituent 3 since the second connector constituent 5 is pushed by the connector cover body 7 (see FIG. 9).

Then, the first locked part 19 and the second locked part 21 are restored and detached from the second abutment part 29, so that the first locked part 19 is locked to the first locking part 13, while the second locked part 21 is locked to the second locking part 15. As a result, the second terminal 17 is joined to the first terminal 9 (see FIG. 10).

When approaching the connector cover body 7 to the first connector constituent 3 under the condition that the first locked part 19 and the second locked part 21 are restored and detached from the second abutment part 29, the second connector constituent 5 is no longer pushed by the connector cover body 7. Therefore, only the connector cover body 7 approaches the first connector constituent 3.

Subsequently, the second cylindrical part 25 of the connector cover body 7 enters the insides of the first locked part 19, which is locked to the cylindrical part 11 of the first connector constituent 3, and the second locked part 21 which is locked to the second locking part 15. As a result, the locked-part holding part 31 maintains the state where the first locked part 19 is locked to the first locking 13 while the second locked part 21 is locked to the second locking part 15 (see FIG. 11).

The connector cover body 7, the second connector constituent 5, and the first connector constituent 3 are integrated with each other since the locked-part holding part 31 maintains the state where the first locked part 19 is locked to the first locking 13 while the second locked part 21 is locked to the second locking part 15. Thus, the installation of the connector cover body 7 and the second connector constituent 5 to the first connector constituent 3 is completed.

Each of the first locking part 13 of the first connector constituent 3 and the second locking part 15 of the first connector constituent 3 is composed of a through hole formed in the cylindrical part 11 (through hole penetrating through a solid portion of the cylindrical part). In connection, instead of the through hole, each of the first locking part 13 and the second locking part 15 may be composed of a concave part (concave part which is formed on an inner surface of the cylindrical part 11 and also depressed toward the outer circumferential side of the cylindrical part 11). That is, each of the first locking part 13 and the second locking part 15 may be composed of either one of the through hole and the concave part.

The second connector constituent 5 includes a first cylindrical part 35. The first cylindrical part 35 has an outer diameter somewhat smaller than the inner diameter of the first connector constituent 3 of the cylindrical part 11.

The first locked part 19 is composed of a first elastic arm 37. The first elastic arm 37 is formed in a cantilever shape and also elongated so as to project from the outer circumference of the first cylindrical part 35 obliquely to a generatrix of the outer circumference of the first cylindrical part 35 (i.e. a center axis C1 of the first cylindrical part 35).

The second locked part 21 is also formed in a cantilever shape and composed of a second elastic arm 39. The second elastic arm 39 is elongated so as to project from the outer circumference of the first cylindrical part 35 (in a region different from the circumferential region where the first elastic arm 37 does project) obliquely to the generatrix of the outer circumference of the first cylindrical part 35 (i.e. a center axis C1 of the first cylindrical part 35).

Figure 4:
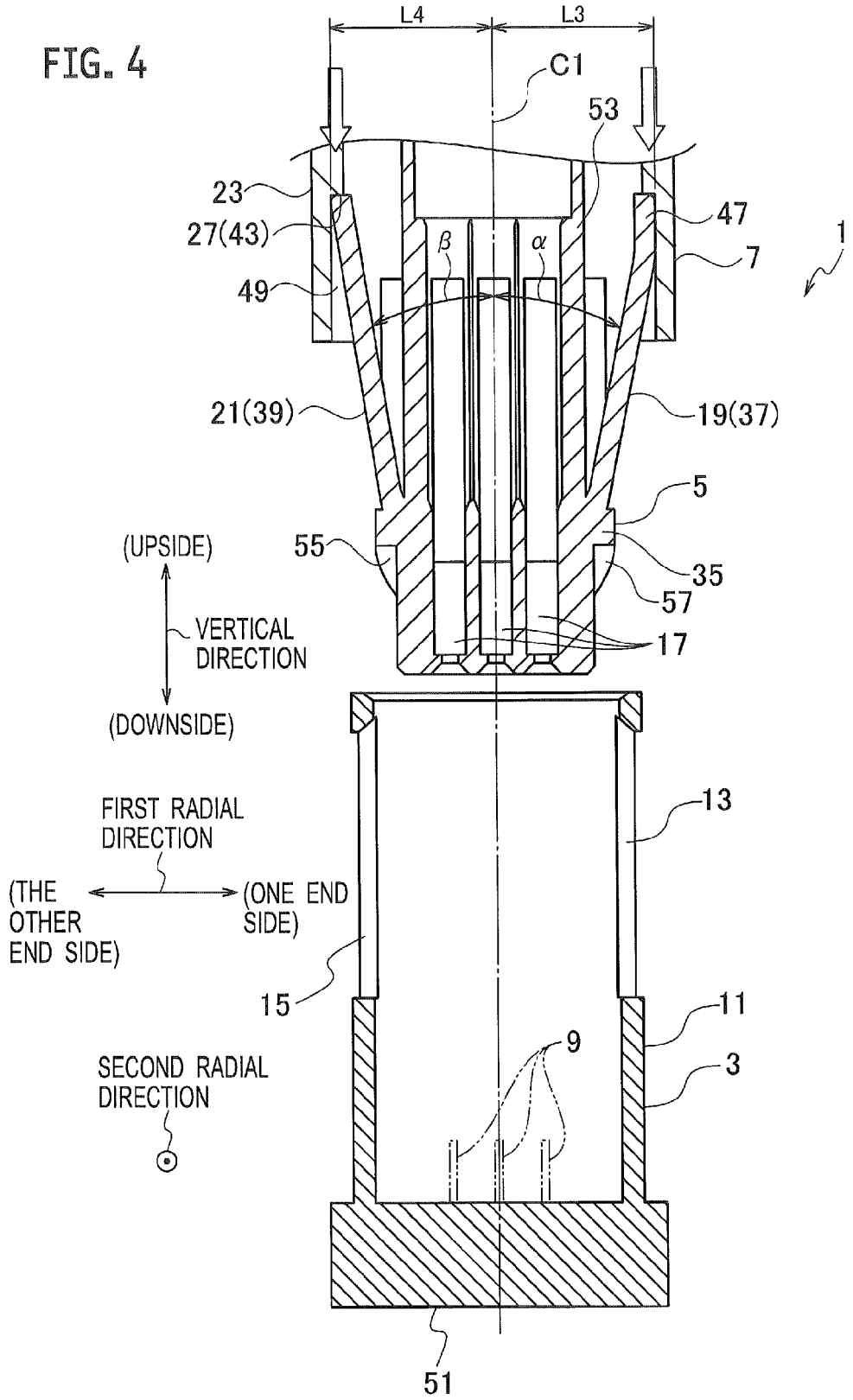
FIG. 4 is a view illustrating a situation of starting to install the second connector constituent and a connector cover body into a first connector constituent, in the connector according to the embodiment.

The crossing angle (acute crossing angle) $\alpha$ of the first elastic arm 37 to the generatrix (center axis C1) of the outer circumference of the first cylindrical part 35 is larger than the crossing angle (acute crossing angle) $\beta$ of the second elastic arm 39 to the generatrix (center axis C1) of the outer circumference of the first cylindrical part 35 (see FIG. 4).

The connector cover body 7 includes a third cylindrical part 41. The first cylindrical part 23 of the connector cover body 7 has an inner diameter somewhat larger than the outer diameter of the cylindrical part 11 of the first connector constituent 3. The first cylindrical part 23 is arranged coaxially with the third cylindrical part 41 of the connector cover body 7 and projects from one end of the third cylindrical part 41 in the extending direction of the center axis C1.

The second cylindrical part 25 of the connector cover body 7 has an outer diameter somewhat smaller than the inner diameter of the cylindrical part 11 of the first connector constituent 3. The second cylindrical part 25 is arranged coaxially with the third cylindrical part 41 of the connector cover body 7 and projects from one end of the third cylindrical part 41 in the extending direction of the center axis C1 at a length shorter than the length of the first cylindrical part 23 of the connector cover body 7. That is, in the extending direction of the central axis C1 of the third cylindrical part 41, a distance L1 between the first abutment part 27 and the third cylindrical part 41 is larger than a distance L2 between the second abutment part 29 and the third cylindrical part 41 (see FIG. 8).

The first abutment part 27 is composed of a stepped part 43 which is foiled on the inner circumference of the first cylindrical part 23 of the connector cover body 7 at an intermediate part of the connector cover body 7 in the extending direction of the central axis C1 of the first cylindrical part 23.

The second abutment part 29 is composed of a tip portion of the second cylindrical part 25 of the connector cover body 7 (an end opposite to the third cylindrical part 41).

In the state before approaching the connector cover body 7 to the first connector constituent 3 to join the second terminal 17 to the first terminal 9 in a situation where the first locked part 19 and the second locked part 21 abut on the first abutment part 27 so that the second connector constituent 5 is installed in the connector cover body 7, for example, in an integrated manner, respective elements of the connector are as follows (see FIG. 4).

The cylindrical part 11 of the connector constituent 3, the first cylindrical part 35 of the second connector constituent 5, and the third cylindrical part 41 of the connector cover body 7 are arranged coaxially with each other.

The second connector constituent 5 is installed on one side of the connector cover body 7 in the extending direction of the center axis C1 of the first cylindrical part 23. On the one side of the connector cover body 7 in the extending direction of the center axis C1 of the first cylindrical part 23, the first connector constituent 3 is distant from the second connector constituent 5 and the connector cover body 7. In the extending direction of the center axis C1 of the first cylindrical part 23 of the connector cover body 7, there are aligned the connector cover body 7, the second connector constituent 5, and the first connector constituent 3, in this order.

In the first elastic arm 37 and the second elastic arm 39, additionally, their respective bases are located close to the center axis C1 of the first cylindrical part 35 of the second connector constituent 5, on the side of the first connector constituent 3. Their tips are located far from the center axis C1 of the first cylindrical part 35 of the second connector constituent 5, on the side of the connector cover body 7.

Then, the tip portion of the first elastic arm 37 and the tip portion of the second elastic arm 39 abut on the stepped part 43 formed on the inner circumference of the first cylindrical part 23 of the connector cover body 7.

Under condition that the first locked part 19 and the second locked part 21 abut on the second abutment part 29, the tip portion of the first elastic arm 37 and the tip portion of the second elastic arm 39 abut on the tip portion of the second cylindrical part 25 of the connector cover body 7.

Figure 10:
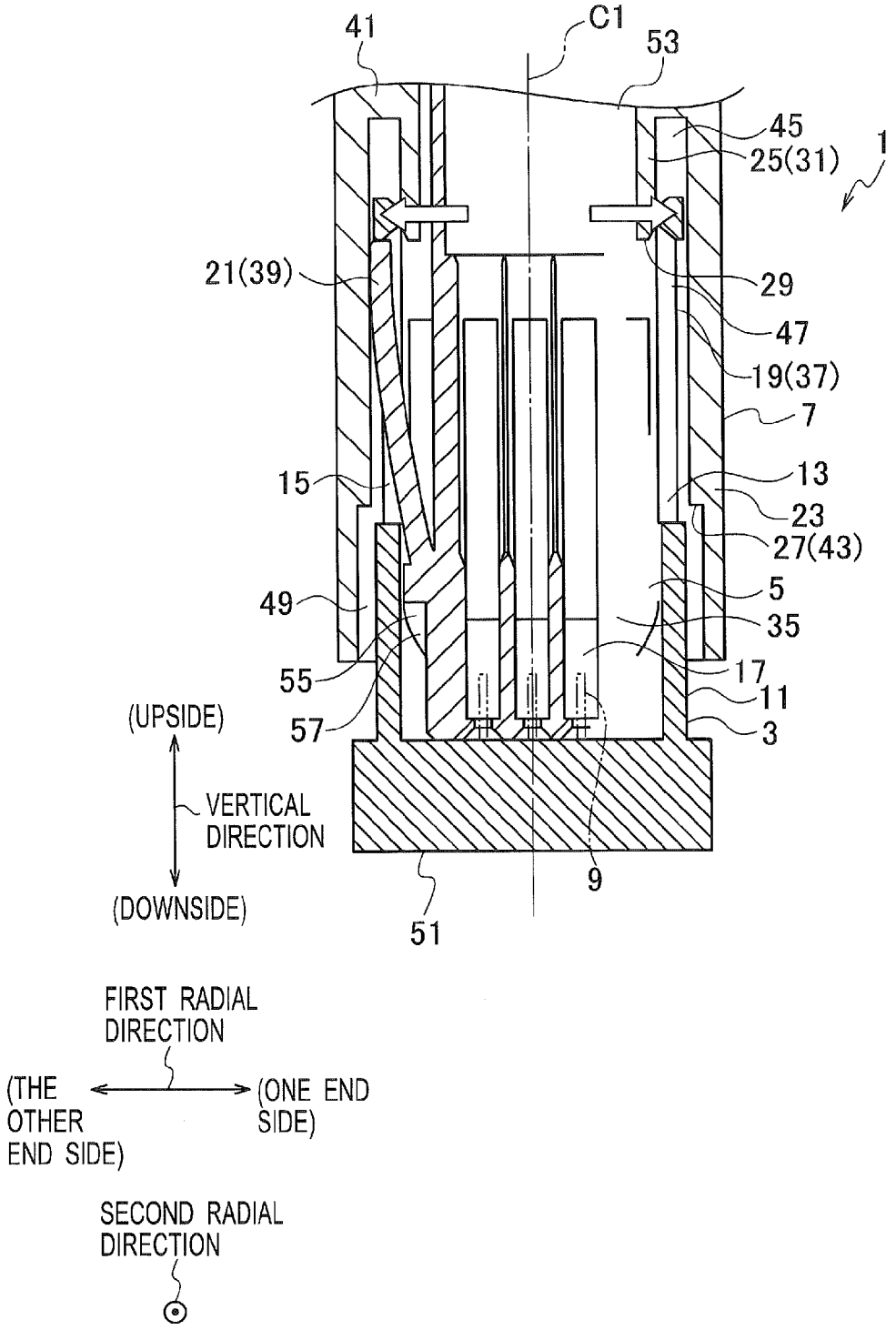
FIG. 10 is a view illustrating a situation in the course of installing the second connector constituent and the connector cover body into the first connector constituent, in the connector according to the embodiment.
Figure 11:
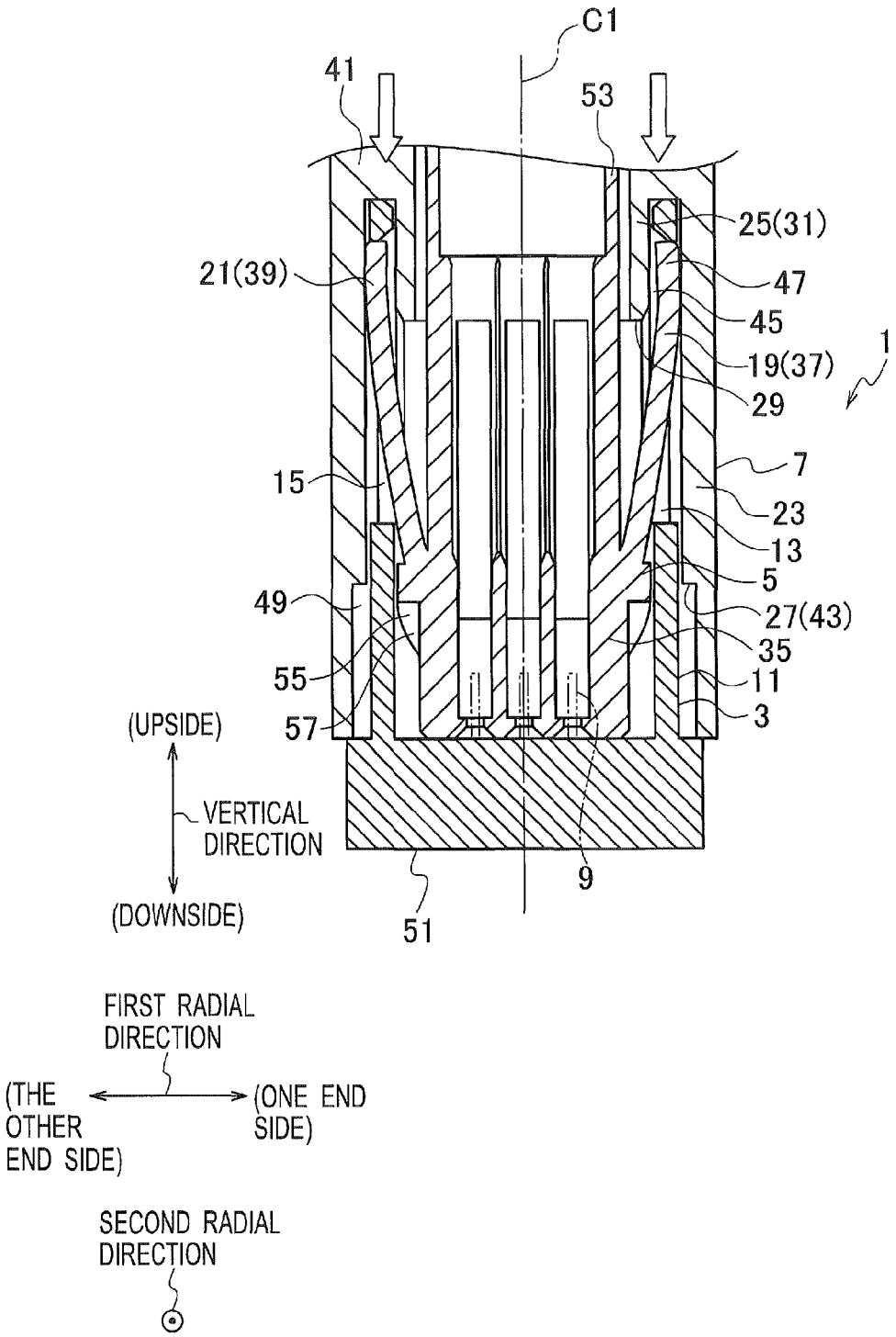
FIG. 11 is a view illustrating a situation of finishing installing the second connector constituent and the connector cover body into the first connector constituent, in the connector according to the embodiment.

Under condition that the first locked part 19 is locked to the first locking part 13, as illustrated in FIGS. 10 and 11, the first elastic arm 37 enters the through hole 13 of the first connector constituent 3. While, under condition that the second locked part 21 is locked to the second locking part 15, the second elastic arm 37 enters the through hole 15 of the first connector constituent 3.

For further illustration, as illustrated in FIGS. 10 and 11, the cylindrical part 11 of the first connector constituent 3, the first locked part 19 being locked to the first locking part 13, and the second locked part 21 being locked to the second locking part 15 enter a gap 45 between of the first cylindrical part 23 of the connector cover body 7 and the second cylindrical part 25 of the connector cover body 7. With such an arrangement, the locked-part holding part 31 operates to maintain the condition where the first locked part 19 is being locked to the first locking part 13, while the second locked part 21 is being locked to the second locking part 15.

That is, when the locked-part holding part 31 maintains the condition where the first locked part 19 is being locked to the first locking part 13 and the second locked part 21 is being locked to the second locking part 15, then the cylindrical part 11 of the first connector constituent 3, the first locked part 19 being locked to the first locking part 13, and the second locked part 21 being locked to the second locking part 15 are pinched between the first cylindrical part 23 and second cylindrical part 25 of the connector cover body 7.

Thus, the first locked part 19 locked to the first locking part 13 and the second locked part 21 locked to the second locking part 15 are prevented from being deflected. As a result, the locked-part holding part 31 maintains the condition where the first locked part 19 is being locked to the first locking part 13, while the second locked part 21 is being locked to the second locking part 15.

The tip portion 47 of the first elastic arm 37 extends in parallel with the center axis C1 of the first cylindrical part 35 of the second connector constituent 5. A distance L3 between the center axis C1 of the first cylindrical part 35 of the second connector constituent 5 and the outer circumferential end of the tip portion 47 of the first elastic arm 37 becomes equal to a distance L4 between the center axis C1 of the first cylindrical part 35 of the second connector constituent 5 and the outer circumferential end of the tip portion of the second elastic arm 39 (see FIG. 4).

In the state before approaching the connector cover body 7 to the first connector constituent 3 to join the second terminal 17 to the first terminal 9 in a situation where the first locked part 19 and the second locked part 21 abut on the first abutment part 27 so that the second connector constituent 5 is installed in the connector cover body 7 integrally, as illustrated in FIG. 4, the outer circumferential end of the tip portion 47 of the first elastic arm 37 and the outer circumferential end of the tip portion of the second elastic arm 39 come in contact with the inner wall of the first cylindrical part 23 of the connector cover body 7.

For further illustration, a cylindrical notch 49 is provided at the leading end of the first cylindrical part 23 of the connector cover body 7. In an area provided with the cylindrical notch 49, the inner diameter of the first cylindrical part 23 of the connector cover body 7 is enlarged, so that a step part 43 is formed at the base end of the notch 49. The outer circumferential end of the tip portion 47 of the first elastic arm 37 and the outer circumferential end of the tip portion of the second elastic arm 39 come in contact with the inner circumference of the notch 49.

Here, the connector 1 will be described in more detail. For convenience of explanation, the extending direction of the center axis C1 of the cylindrical parts 11, 23, 25, 35 and 41 is defined as "vertical direction", a given direction perpendicular to the vertical direction defined as "first radial direction" and another given direction perpendicular to the first radial direction is defined as "second radial direction".

Similarly to the connector of the second conventional example illustrated in PTL 2, the first connector constituent 3 of the connector 1 is integrally installed in a cylinder head (not illustrated) through an externally threaded part (not illustrated). Therefore, when the first connector constituent 3 is installed in the cylinder head, the rotating angle of the first connector constituent 3 around the center axis C1 does not become constant but varies due to individual differences of the first connector constituent 3 and the cylinder head. For instance, if respective first connector constituents 3 of two connectors 1 are installed in two cylinder heads respectively, the rotating angle of the first connector constituent 3 on one side around the center axis C1 will be different from that of the first connector constituent 3 on the other side around the center axis C1 in many cases although there is a case that the former happens to coincide with the later.

In order to keep the rotating position of the third terminal (i.e. a terminal projecting in a direction perpendicular to the center axis C1) 33 to be connected with a wire harness constant, meanwhile, it is required for the connector cover body 7 to keep the rotational angle around the center axis C1 constant.

Further, each of the first terminal 9 of the first connector constituent 3 and the second terminal 17 of and the second connector constituent 5 is composed of a plurality of terminals. Therefore, when installing the second connector constituent 5 in the first connector constituent 3 installed in the cylinder head, it is necessary to rotate (revolve) the second connector constituent 5 around the center axis C1 appropriately so that respective male terminals of the first terminal 9 of the first connector constituent 3 are joined to respective female terminals of the second terminal 17 of the second connector constituent 5.

For this necessity, the second connector constituent 5 is adapted so as to be rotatable about the center axis C1 to the connector cover body 7 within a predetermined angular range (e.g. ±180°). Also, for this necessity, there is provided a rotating positioning part (not illustrated) that, when installing the second connector constituent 5 and the connector cover body 7 in the first connector constituent 3 in the cylinder head, allows the second connector constituent 5 to engage with the first connector constituent 3 thereby determining the rotating position of the second connector constituent 5. Owing to the rotating positioning part similar to the connector of the second conventional example illustrated in PTL 2, the second connector constituent 5 is guided by the first connector constituent 3, so that the second connector constituent 5 is brought into the formal fitting position in relation to the first connector constituent 3.

The first connector constituent 3 includes a cylindrical part 11 and a bottom wall part 51. The first connector constituent 3 is provided, in the cylindrical part 11, with a guide rib (not illustrated) which is similar to the connector of the second conventional example illustrated in PTL 2.

The bottom wall part 51 closes up a lower end of the cylindrical part 11 of the first connector constituent 3. The inside of the cylindrical part 11 of the first connector constituent 3 defines a terminal fitting chamber in which the first terminal 9 protrudes from the bottom wall part 51 upwardly.

On the downside of the bottom wall part 51, an external threaded part (not illustrated) is formed to install the first connector constituent 3 in the cylinder head (not illustrated). Inside the external threaded part, there is an ignition device, such as a glow plug.

Each of the locking parts 13, 15 may be composed of a plurality of through holes. The through holes constituting the locking parts 13, 15 may be arranged in multiple positions, for example, six positions where the circumference of the cylindrical part 11 of the first connector constituent is divided into six portions. Six through holes only need to be formed in the same configuration. Each of the locking parts 13, 15 is shaped in the form of e.g. an elongated rectangle and extends long in an upper intermediate portion of the cylindrical part 11 vertically.

The second connector constituent 5 includes a first cylindrical part 35 and a second cylindrical part 53. The first cylindrical part 35 and the second cylindrical part 53 are coaxial with each other. The second cylindrical part 53 is connected to the top of the first cylindrical part 35.

A cylindrical notch 55 is formed in the lower region of the first cylindrical part 35. At the notch 55, the outer diameter of the first cylindrical part 35 is reduced. The outer diameter of the second cylindrical part 53 is somewhat smaller than the outer diameter of a portion of the first cylindrical part 35 provided with the notch 55. The second terminal 17 is provided in the first cylindrical part 35.

The first elastic arm 37 extends from the upper end of the first cylindrical part 35 (at the step on the boundary between the first cylindrical part 35 and the second cylindrical part 53) obliquely upward. That is, the first elastic arm 37 extends apart from the upper end of the first cylindrical part 35, apart from the first cylindrical part 35 in the radial direction of the first cylindrical part 35 and upwardly in the extending direction of the center axis C1 of the first cylindrical part 35.

The second elastic arm 39 also extends from the upper end of the first cylindrical part 35 obliquely upward in the same way as the first elastic arm 37.

Corresponding to the through holes constituting the respective locking parts 13, 15, the respective elastic arms 37, 39, may be provided in six positions obtained by equally dividing the circumference of the first cylindrical part 35 into six portions. Then, the first elastic arms 37 and the second elastic arms 39 need only be arranged alternately.

The vertical dimension of the first cylindrical part 35 of the second connector constituent 5 gets smaller than a distance between the lower end of the cylindrical part 11 of the first connector constituent 3 and each lower end of the respective through holes constituting the respective locking parts 13, 15 (see FIG. 11).

The sum of the vertical dimension of the first cylindrical part 35 of the second connector constituent 5 and the vertical dimension of each elastic arms 37, 39 becomes substantially equal to a distance between the lower end of the cylindrical part 11 of the first connector constituent 3 and each upper end of the respective through holes constituting the locking parts 13, 15 (see FIG. 11). The vertical dimension of each elastic arm 37, 39 is somewhat larger than each vertical dimension of the respective through holes constituting the locking parts 13, 15. The upper end of the second connector constituent 5 is positioned above the upper ends of the elastic arms 37, 39.

In the state before installing the second connector constituent 5 and the connector cover body 7, which are integrated with each other, in the first connector constituent 3, as illustrated in FIG. 4, for example, the first elastic arm 37 and the second elastic arm 39 are somewhat deformed toward the center axis C1 elastically, and the tip portion of the first elastic arm 37 and the tip portion of the second elastic arm 39 press against the inner surface of the first cylindrical part 23 in which the notch 49 of the connector cover body 7 is formed.

The notch 55 is provided in the first cylindrical part 35 of the second connector constituent 5. The upper end of the notch 55 constitutes a guide rail face 57 as the rotating direction guiding part which is similar to the second conventional example illustrated in PTL 2. The guide rail face 57 is in the form of a cut surface obtained by cutting an upper portion of a cylindrical body by a plane crossing obliquely to the center axis C1.

When lowering the second connector constituent 5 and the connector cover body 7 in order to install the second connector constituent 5 and the connector cover body 7 in the first connector constituent 3, the guide rib is engaged with the guide rail face 57 and additionally, the second connector constituent 5 rotates around the center axis C1, in relation to the first connector constituent 3 and the connector cover body 7, thereby effecting the rotating positioning.

After this rotating positioning is carried out, the respective male terminals of the first terminal 9 and the respective female terminals of the second terminal 17 are joined to each other, so that the first locked part 19 is locked to the first locking part 13, while the second locked part 21 is locked to the second locking part 15.

The inner diameter of the first cylindrical part 23 of the connector cover body 7 gets somewhat larger than the outer diameter of the cylindrical part 11 of the first connector constituent 3. The outer diameter of the second cylindrical part 25 of the connector cover body 7 gets somewhat larger than the inner diameter of the cylindrical part 11 of the first connector constituent 3. The outer diameter of the second cylindrical part 25 of the connector cover body 7 is set so as not to interfere with the elastic arms 37, 39. The inner diameter of the second cylindrical part 25 of the connector cover body 7 gets larger than the outer diameter of the second cylindrical part 53 of the second connector constituent 5.

The outer diameter of the third cylindrical part 41 of the connector cover body 7 becomes equal to the outer diameter of the first cylindrical part 23 of the connector cover body 7. The inner diameter of the third cylindrical part 41 of the connector cover body 7 becomes equal to the inner diameter of the second cylindrical part 25 of the connector cover body 7.

As illustrated in FIG. 11, the vertical dimension of the first cylindrical part 23 of the connector the cover body 7 becomes substantially equal to the vertical dimension of the cylindrical part 11 of the first connector constituent 3. The vertical dimension of the notch 49 provided in the first cylindrical part 23 of the connector the cover body 7 becomes smaller than a distance between the lower end of the cylindrical part 11 of the first connector constituent 3 and each lower end of the respective through holes constituting the respective locking parts 13,15.

The vertical dimension of the second cylindrical part 25 of the connector cover body 7 is smaller than the vertical dimension of the first cylindrical part 23 of the connector the cover body 7, and larger than a distance between the upper end of the cylindrical part 11 of the first connector constituent 3 and each upper end of the through holes constituting the respective locking parts 13, 15. For example, this vertical dimension is nearly equal to the vertical dimension of the first cylindrical part 35 of the second connector constituent 5.

Furthermore, the connector cover body 7 is provided with a bottom wall part 59, an attachment arm part 61, and a terminal installation part 63.

The bottom wall part 59 closes up the upper end of the third cylindrical part 41 of the connector cover body 7. The attachment arm part 61 is adapted so as to project from the bottom wall part 59 to one side of the first radial direction. The terminal installation part 63 is arranged above the bottom wall part 59. The third terminal 33 is disposed in the terminal installation part 63. The terminal installation part 63 opens to one side of the second radial direction. The wire harness installed in the terminal installation part 63 (the third terminal 33) extends to one side of the second radial direction.

The cylinder head (not illustrated) is provided with a recess (not illustrated) opening upwardly. In the connector 1 installed in the cylinder head, a portion above the attachment arm part 61 (the portion including the attachment arm part 61) projects from the recess upwardly, while a portion below the attachment arm part 61 is present in the recess.

The cylinder head is provided, on a bottom surface of the recess, with an internal thread (not illustrated) into which an external thread (not illustrated) of the first connector constituent 2 is screwed.

In the connector 1 installed in the cylinder head, the attachment arm part 61 comes in contact with a region surrounding the recess of the cylinder head. Then the attachment arm part 61 (i.e. the connector cover body 7) is fixed to the cylinder head by a fastening member (not illustrated), for example, an attachment bolt.

Even in a state before the second connector constituent 5 and the connector cover body 7 are installed in the first connector constituent 3 installed in the cylinder head, the second connector constituent 5 and the connector cover body 7 are associated with each other through the wires (not illustrated).

The second connector constituent 5 has the second cylindrical part 53 positioned on the upper side and the first cylindrical part 35 positioned on the lower side. In the connector cover body 7, both the first cylindrical part 23 and the second cylindrical part 25 open downwardly. The upper portion of the second cylindrical part 53 of the second connector constituent 5 and respective upper portions of the elastic arms 37, 39 enter the first cylindrical part 23 of the connector cover body 7.

The wires (not illustrated) connect the second terminal 17 and the third terminal 33 to each other through the interior of the third cylindrical part 41 of the connector cover body 7 and the interior of the second cylindrical part 53 of the second connector constituent 5.

In each of the second connector constituent 5 and the connector cover body 7, there is provided a rotation restricting part (not illustrated) similar to the connector of the second conventional example illustrated in PTL 2. Thus, the rotation amount of the second connector constituent 5 in relation to the connector cover body 7 is restricted within e.g. ±180° about the center axis C1, so that the wires (not illustrated) are prevented from being twisted excessively.

Figure 2:
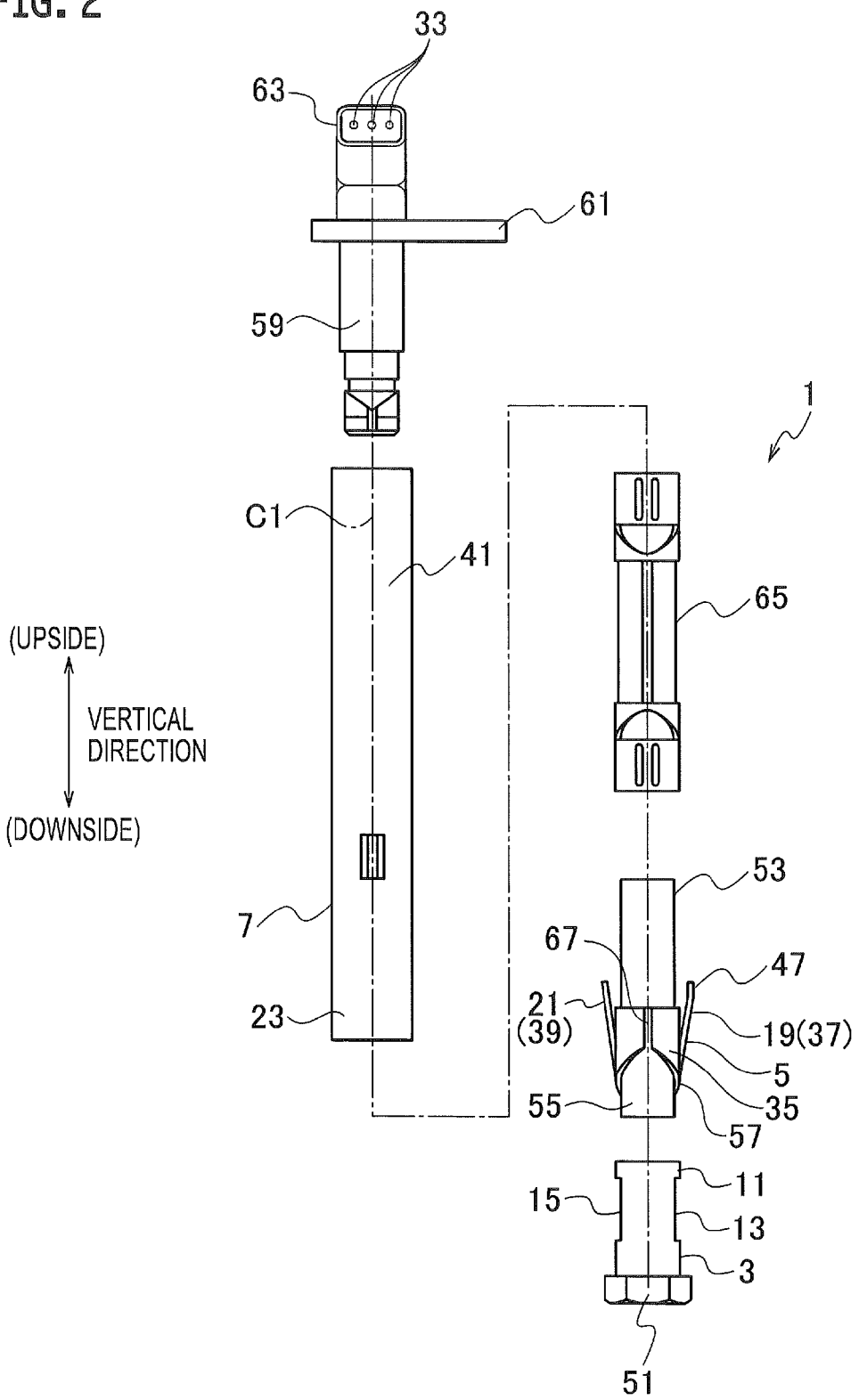
FIG. 2 is an exploded view of the connector according to the embodiment.

As illustrated in FIG. 2, the connector 1 is provided with a cylindrical rotating equipment 65 and a compression coil spring (not illustrated) illustrative of an elastic body.

The rotating equipment 65 is arranged inside the third cylindrical part 41 of the connector cover body 7. The center axis of the rotating equipment 65 coincides with the center axis C1 of the third cylindrical part 41 of the connector cover body 7. The rotating equipment 65 is adapted so as to be rotatable to the connector cover body 7 around the center axis C1 of the third cylindrical part 41 and also movable in the vertical direction.

The second connector constituent 5 is engaged with the rotating equipment 65. The second connector constituent 5 is adapted so as to be rotatable to the rotating equipment 65 around the center axis C1 and also movable in the vertical direction.

The rotating equipment 65 and the connector cover body 7 are provided, in common, with rotation restricting parts (not illustrated). Thus, both the second connector constituent 5 and the rotating equipment 65 are provided with the rotation restricting parts, respectively.

Consequently, the rotating equipment 65 rotates to the connector cover body 7 within a given angular range (only ±90°) around the central axis C1. The second connector constituent 5 also rotates to the rotating equipment 65 within a given angular range (only ±90°) around the central axis C1. As a result, the second connector constituent 5 is adapted so as to be rotatable to the connector cover body 7 within a given angular range (only ±180°) around the central axis C1.

The rotating equipment 65 and the connector cover body 7 are provided, in common, with vertical movement restricting parts (not illustrated). Thus, both the second connector constituent 5 and the rotating equipment 65 are provided with the rotation restricting parts, respectively.

Consequently, the rotating equipment 65 moves vertically to the connector cover body 7 by a predetermined distance. The second connector constituent 5 also moves vertically to the rotating equipment 65 by a predetermined distance.

In the third cylindrical part 41 of the connector cover body 7, the compression coil spring (not illustrated) is arranged between the bottom wall part 59 and the second connector constituent 5. The compression coil spring urges the second connector constituent 5 downwardly.

By this urging, in the state before the second connector constituent 5 is installed in the first connector constituent 3 installed in the cylinder head, the rotating equipment 65 is located at the lowermost position in relation to the connector cover body 7, while the second connector constituent 5 is located at the lowermost position in relation to the rotating equipment 65.

Also, by this urging, the rotating equipment 65 is located in a default rotational position (i.e. a position allowing the equipment to rotate in both forward and reverse directions by only 90° each) in relation to the connector cover body 7, while the second connector constituent 5 is located in a "default" rotational position in relation to the rotation equipment 65.

Thus, the second connector constituent 5 is positioned in the default rotational position in relation to the connector cover body 7 and therefore, the second connector constituent 5 becomes rotatable to the connector cover body 7 in the forward and reverse directions by only 180° each (±180°).

Next, we now describe the assembling operation of installing the second connector constituent 5 and the connector cover body 7 in the first connector constituent 3 installed in the cylinder head.

In an initial state, as illustrated in FIG. 4 etc., the second connector constituent 5 (the connector cover body 7) is assembled to be apart from the first connector constituent 3 and thus located above the first connector constituent 3. Also, in the initial state, the center axes C1 of the first connector constituent 3, the second connector constituent 5, and the connector cover body 7 are assumed to coincide with each other. Moreover, in the initial state, the second connector constituent 5 and the connector cover body 7 are assumed to be integrated with each other by a small retaining force since the tip portions of the first elastic arm 37 and the second elastic arm 39 press against the connector cover body 7 with small forces (in the direction away from the center axis C1).

In such an initial state, the connector cover body 7 (the second connector constituent 5) is lowered. The guide rib of the first connector constituent 3 abuts on the guide rail face 57 of the second connector constituent 5 at an optional position unless the second connector constituent 5 is inserted to the formal fitting rotational position of the first connector constituent 3. Then, as the guide rib slides on the guide rail face 57, the second connector constituent 5 and the rotating gear 65 rotate in relation to the first connector constituent 3 about the center axis C1 as a rotation center appropriately. Consequently, the second connector constituent 5 is brought into a rotational position where the guide rib occupies the uppermost position of the guide rail face 57. In this way, the second connector constituent 5 and the first connector constituent 3 are brought into the formal fitting rotational positions.

Figure 3:
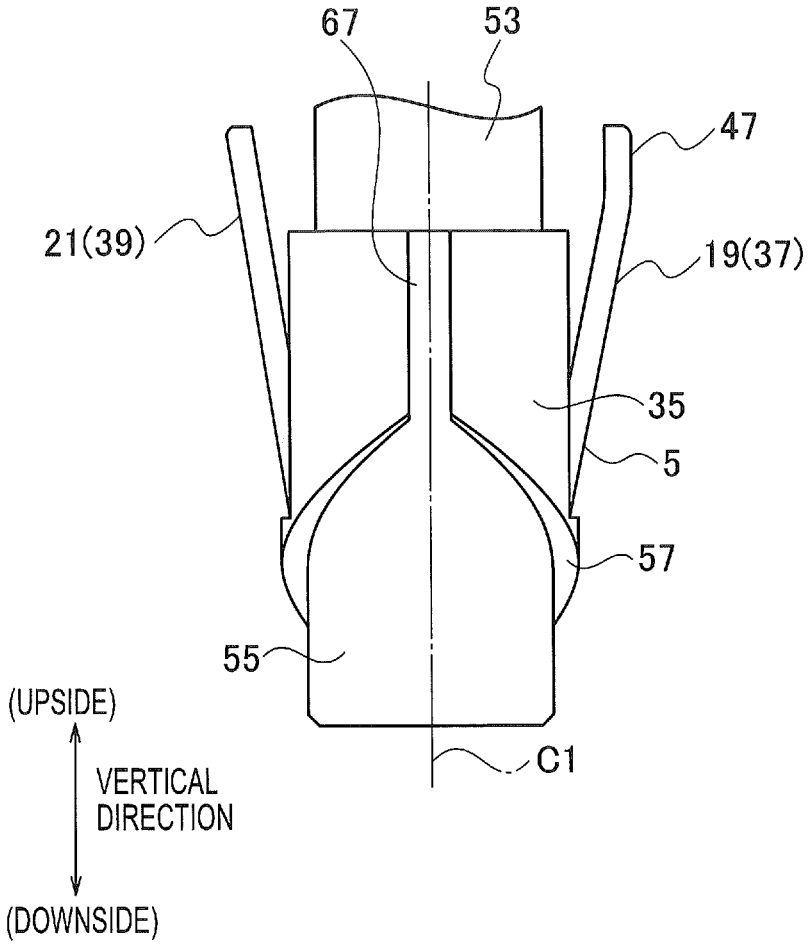
FIG. 3 is a view illustrating a second connector constituent of the connector according to the embodiment.

When the connector cover body 7 (the second connector constituent 5) is further lowered to progress the fitting operation, the guide rib begins to enter a straight guide groove 67 provided in the second connector constituent 5 (see FIG. 3). Thereafter, the joining of the first terminal 9 to the second terminal 17, the engagement of the first locking part 13 with the first locked part 19, and the engagement of the second locking part 15 with the second locked part 21 are initiated. Additionally, as the guide rib enters the guide groove 67, the second connector constituent 5 no longer rotates in relation to the connector cover body 7 around the center axis C1 as a rotation center.

Note that if the second connector constituent 5 starts to be fitted to the first connector constituent 3 in the formal fitting rotational position, the guide rib will enter the guide groove 67 directly without sliding on the guide rail face 57.

When the connector cover body 7 (the second connector constituent 5) is further lowered to progress the fitting operation, as illustrated in FIG. 5, respective downside portions (base end positions) of the elastic arms 37, 39 abut on an opening of the upper end of the cylindrical part 11 of the first connector constituent 3.

Figure 6:
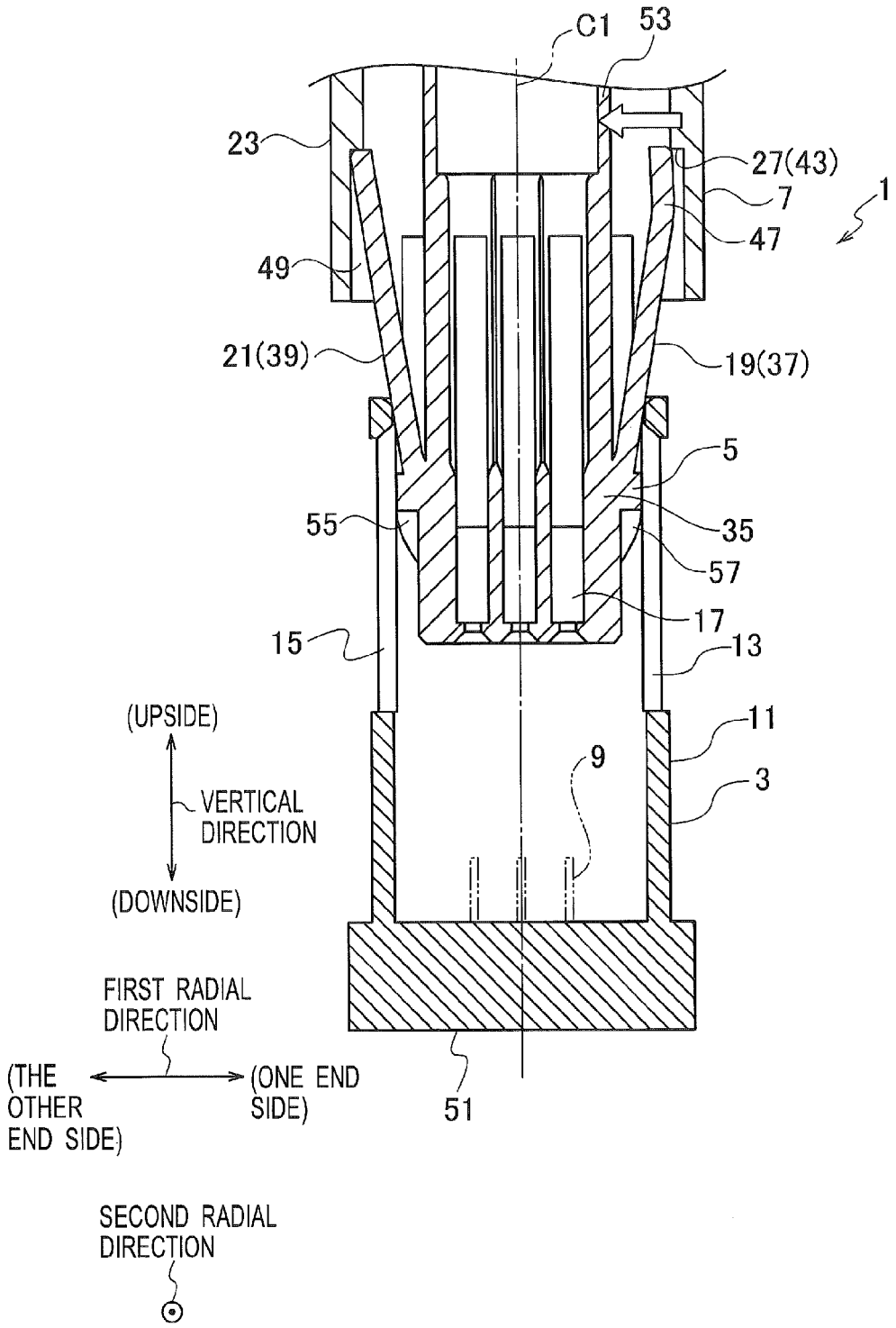
FIG. 6 is a view illustrating a situation in the course of installing the second connector constituent and the connector cover body into the first connector constituent, in the connector according to the embodiment.

When the connector cover body 7 (the second connector constituent 5) is further lowered to progress the fitting operation, as illustrated in FIG. 6, only the first elastic arm 37 is deflected inwardly (on the side of the center axis C1) and detached from the first abutment part 27 (the step part 43) of the connector cover body 7 by a reaction force received from the cylindrical part 11 of the first connector constituent 3. The so detached first elastic arm 37 is brought into a condition that it can abut on the second abutment part 29 of the connector cover body 7 (the lower end of the second cylindrical part 25).

Figure 7:
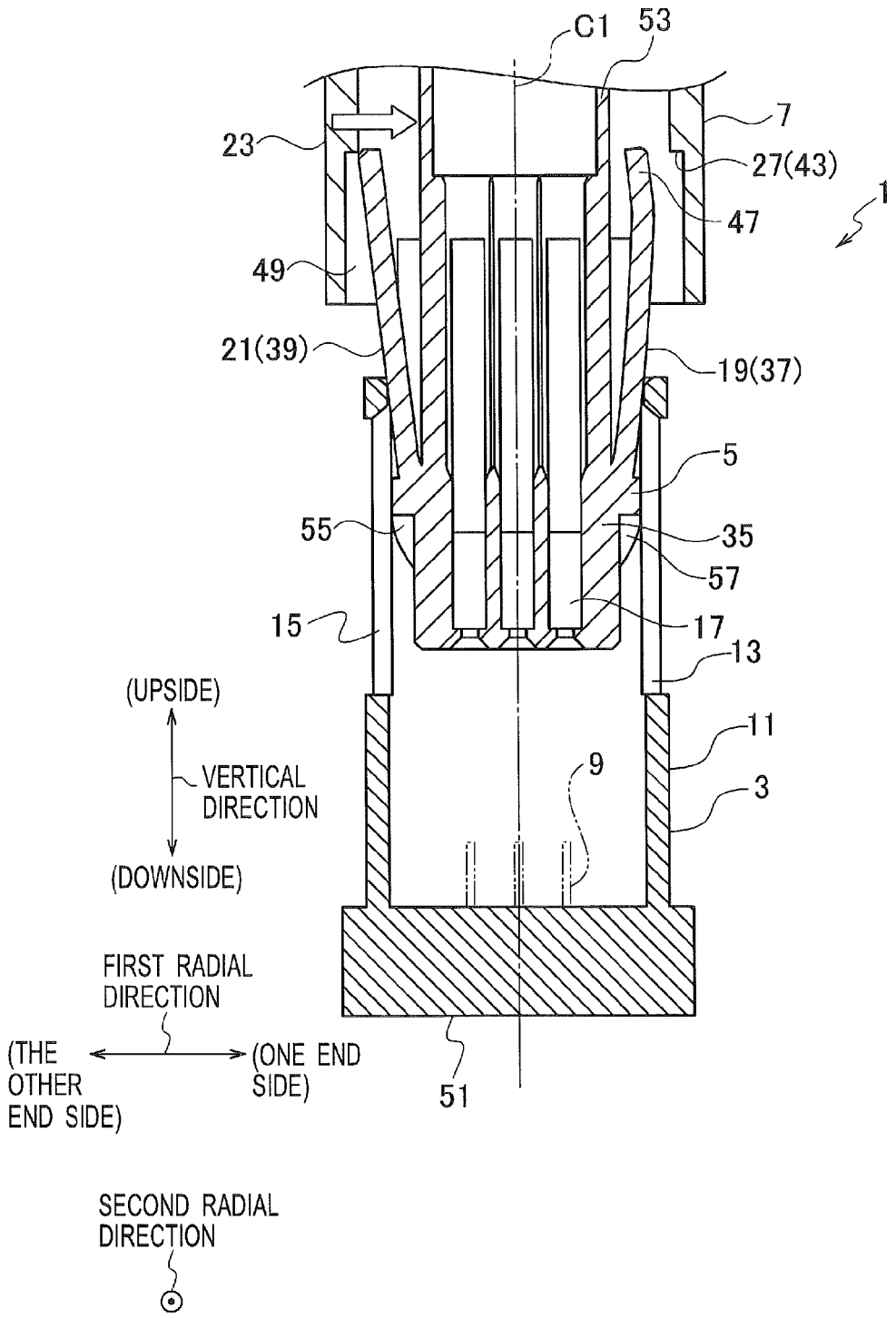
FIG. 7 is a view illustrating a situation in the course of installing the second connector constituent and the connector cover body into the first connector constituent, in the connector according to the embodiment.

When the connector cover body 7 (the second connector constituent 5) is further lowered to progress the fitting operation, as illustrated in FIG. 7, the second elastic arm 39 is deflected by a reaction force received from the cylindrical part 11 of the first connector constituent 3 and thus detached from the first abutment part 27 (the step part 43) of the connector cover body 7. In the states illustrated in FIGS. 7 and 8, at this time, the second elastic arm 39 is not so deflected as to be in a condition that it can abut on the second abutment part 29 of the connector cover body 7 (i.e. the lower end of the second cylindrical part 25). Nevertheless, the second elastic arm 39 may be brought into a condition that it can abut on the second abutment part 29 of the connector cover body 7 (i.e. the lower end of the second cylindrical part 25).

Figure 8:
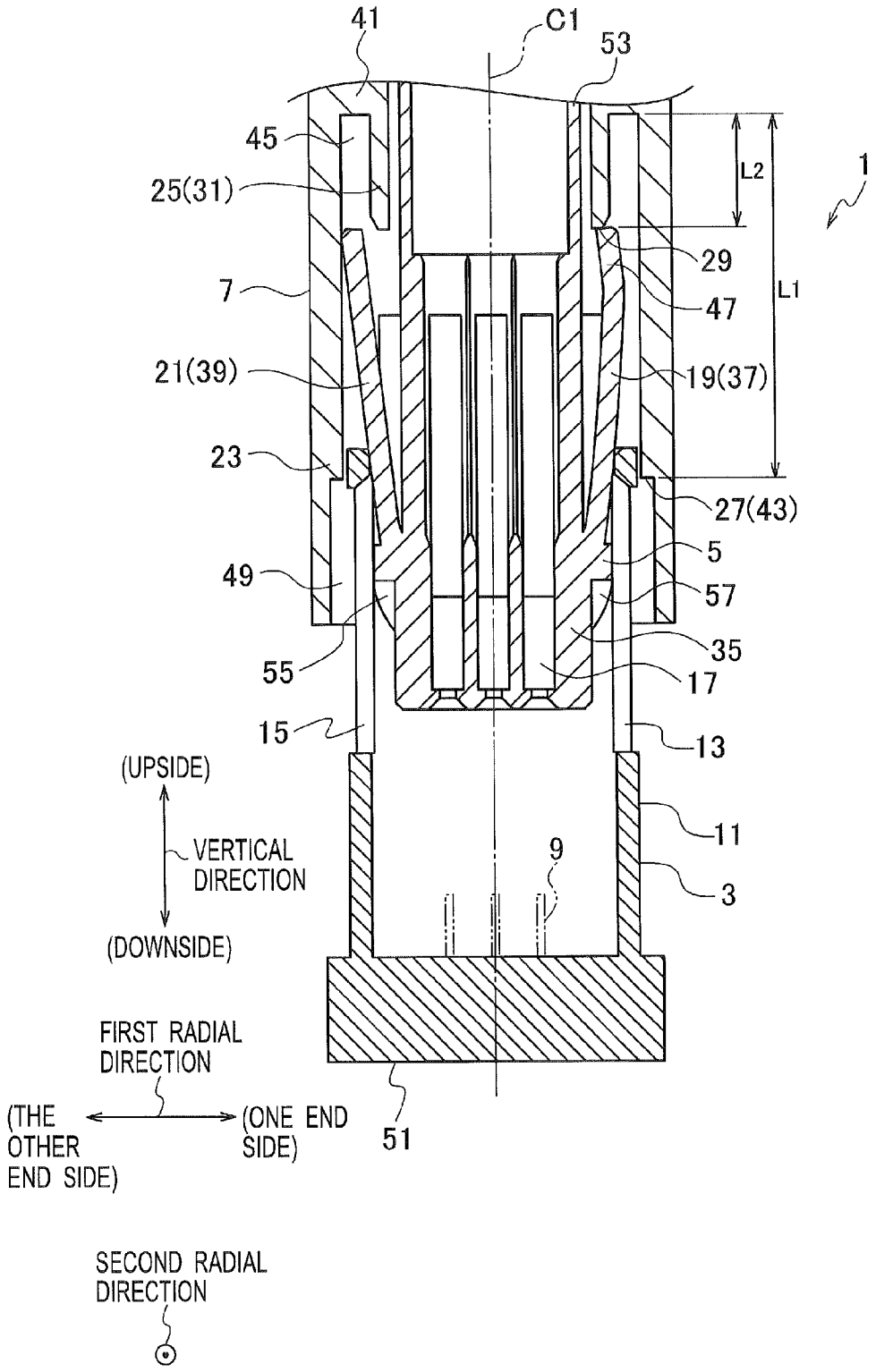
FIG. 8 is a view illustrating a situation in the course of installing the second connector constituent and the connector cover body into the first connector constituent, in the connector according to the embodiment.

When the connector cover body 7 is further lowered to progress the fitting operation, as illustrated in FIG. 8, the connector cover body 7 descends without a movement of the second connector constituent 5 in relation to the first connector constituent 3. Then, the upper end of the first elastic arm 37 abuts on the second abutment part 29 (the lower end of the second cylindrical part 25). In this relation, although only the first elastic arm 37 abuts on the second abutment part 29 in FIG. 8, the connector may be constructed so that both the first elastic arm 37 and the second elastic arm 39 abut on the second abutment part 29.

Figure 9:
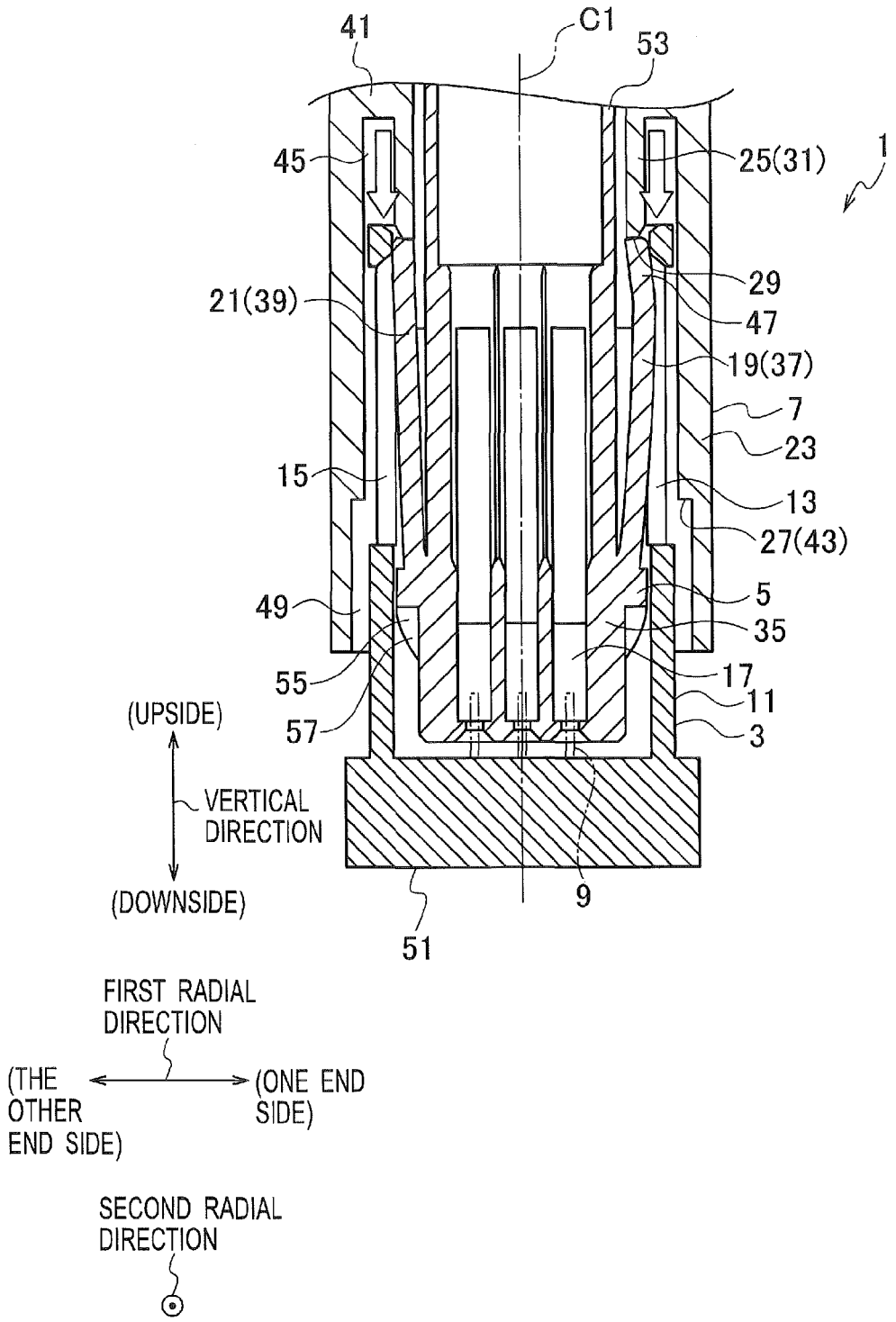
FIG. 9 is a view illustrating a situation in the course of installing the second connector constituent and the connector cover body into the first connector constituent, in the connector according to the embodiment.

When the connector cover body 7 is further lowered to progress the fitting operation, the second connector constituent 5 also descends together with the connector cover body 7, the respective elastic arms 37, 39 enter the inside of the cylindrical part 11 of the first connector constituent 3, as illustrated in FIG. 9.

When the connector cover body 7 is further lowered to progress the fitting operation, as illustrated in FIG. 10, the first elastic arm 37 and the second elastic arms 39 are restored outwardly and detached from the second abutment part 29. As a result, the first elastic arm 37 is locked to the first locking part 13, while the second elastic arm 39 is engaged with the second locking part 15. Additionally, the lower end of the second connector constituent 5 abuts on the bottom wall part 51 of the first connector constituent 3, so that the second terminal 17 is joined to the first terminal 9.

When the connector cover body 7 is further lowered to progress the fitting operation, the connector cover body 7 descends without a movement of the second connector constituent 5 in relation to the first connector constituent 3. Then, as illustrated in FIG. 11, since the second cylindrical part 25 of the connector cover body 7 enters the insides of the cylindrical part 11 of the first connector constituent 3, the first elastic arm 37 being locked to the first locking part 13, and the second elastic arm 39 being locked to the second locking part 15, the locked-part holding part 31 maintains a condition that the first locked part 19 is being locked to the first locking part 13 while the second locked part 21 is being locked to the second locking part 15.

Subsequently, in order to adjust the orientation of the third terminal 33, the rotational position of the connector cover body 7 in relation to the second connector constituent 5 is determined appropriately and successively, the connector cover body 7 is fixed to the cylinder head by use of a bolt (not illustrated). Consequently, the cylinder head, the first connector constituent 3, the second connector constituent 5, and the connector exterior body 7 are integrated with each other by great force. Thus, the installation of the second connector constituent 5 and the connector exterior body 7 in the first connector constituent 3 is completed.

With the connector 1 according to the embodiment, the second cylindrical part 25 of the connector cover body 7 enters the insides of the cylindrical part 11 of the first connector constituent 3, the first locked part 19 being locked to the first locking part 13, and the second locked part 21 being locked to the second locking part 15. As a result, the locked-part holding part 31 is constructed so as to maintain a condition that the first locked part 19 is being locked to the first locking part 13 while the second locked part 21 is being locked to the second locking part 15. For this reason, even if any vibration is added to the second connector constituent 5 installed in the first connector constituent 3, the joining state between the first connector constituent 3 and the second connector constituent 5 is not canceled so easily and therefore, it is possible to ensure the fitting between the first terminal 9 and the second terminal 17. Further, it is possible to suppress an occurrence of slide movement between contacts constituting the first terminal 9 and the second terminal 17, whereby the connector is improved in vibration resistance and electrical contact property.

Further, with the connector 1 according to the embodiment, it is possible to simplify the constitution of the connector in comparison with the connector of the first conventional example illustrated in PTL 1, as similar to the connector of the second conventional example illustrated in PTL 2.

Figure 12:
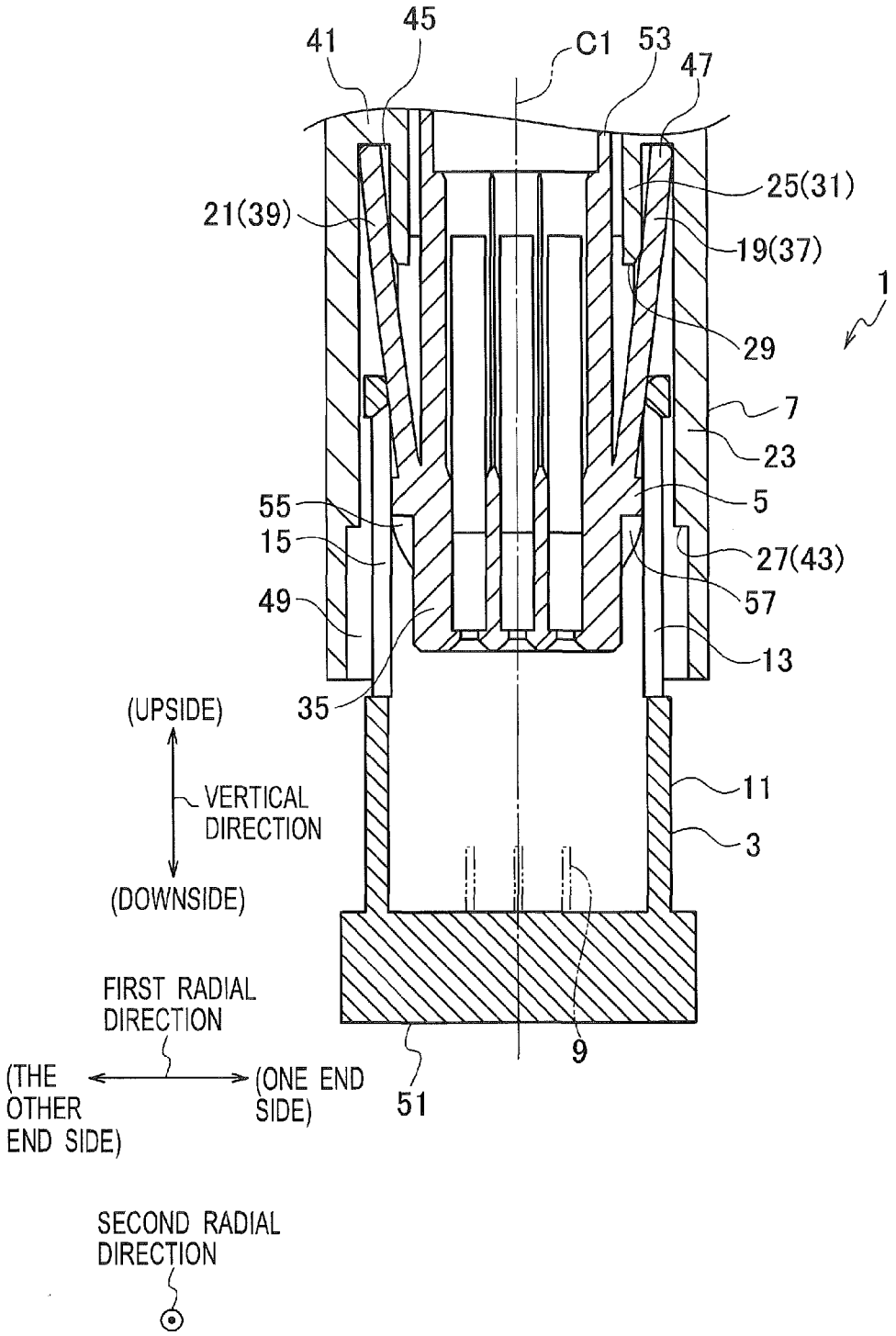
FIG. 12 is a view illustrating a situation where the second connector constituent is engaged with the connector cover body wrongly.
Figure 13:
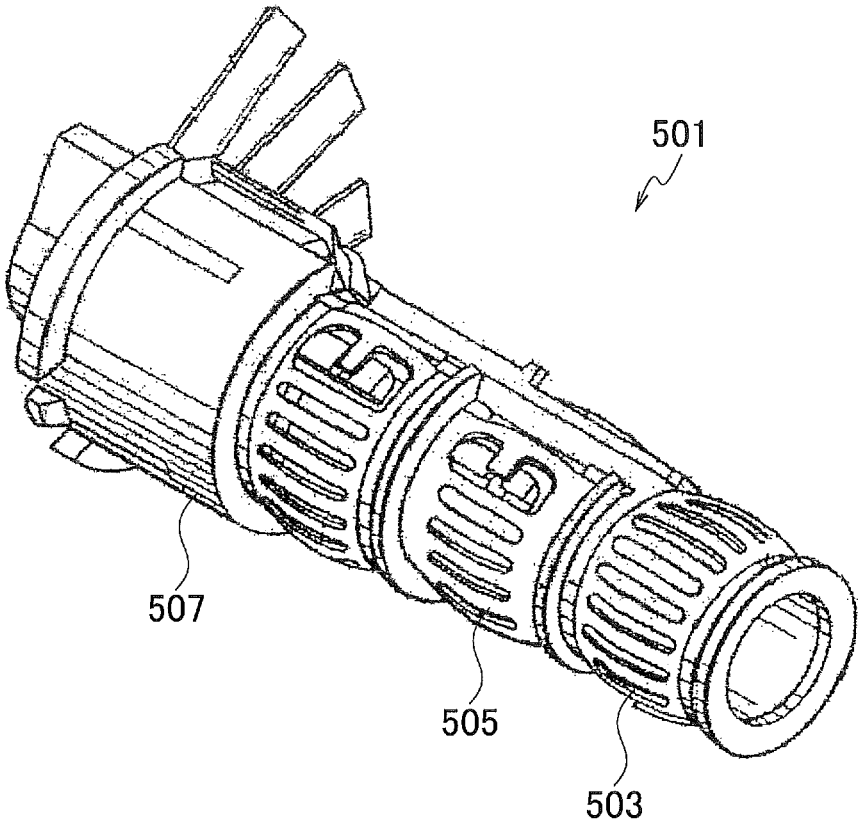
FIG. 13 PRIOR ART
FIG. 13 is a view illustrating a connector according to a first conventional example.
Figure 14:
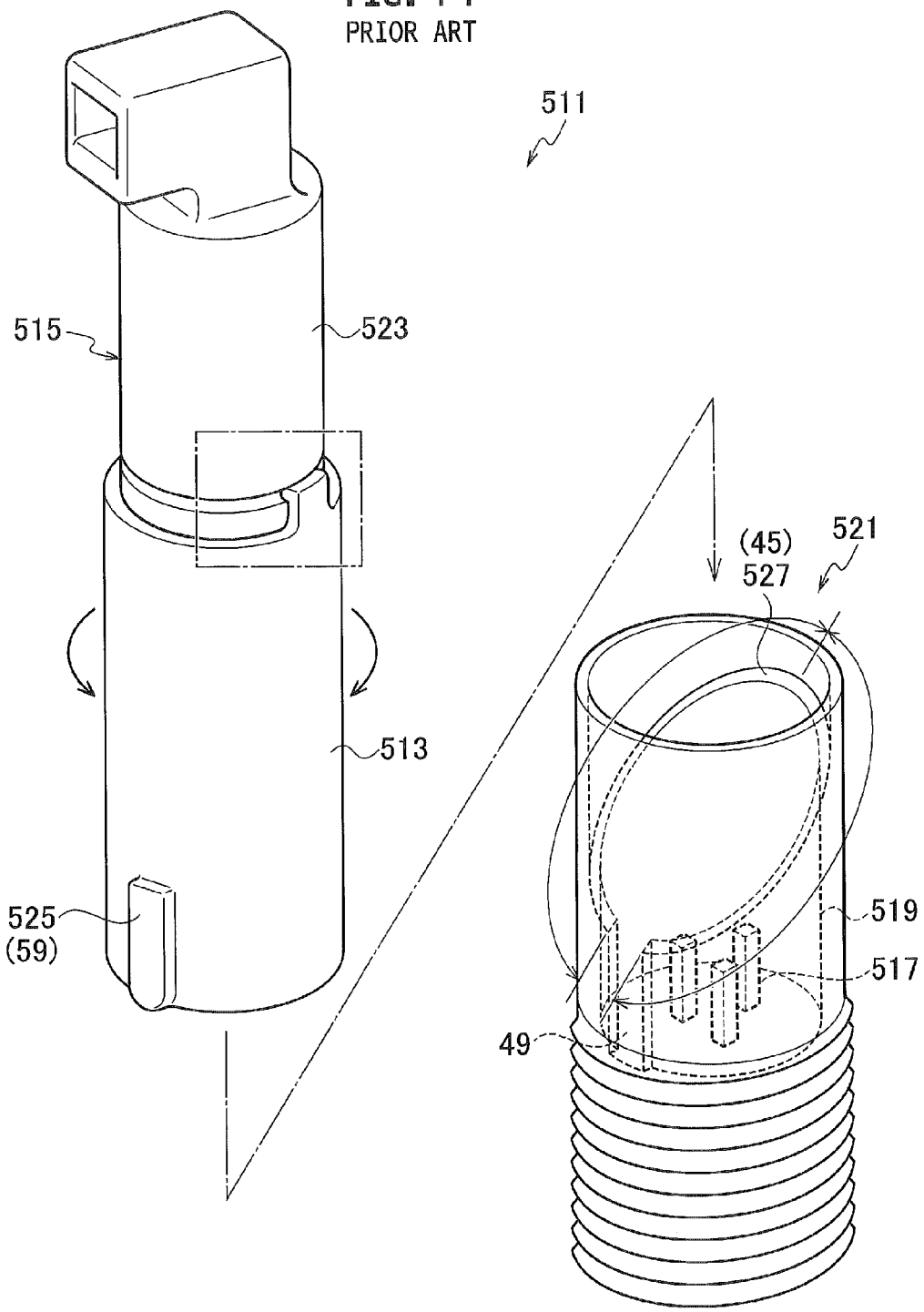
FIG. 14 PRIOR ART
FIG. 14 is a view illustrating a connector according to a second conventional example.

Again, with the connector 1 according to the embodiment, when approaching, from a condition that the second connector constituent 5 is installed in the connector cover body 7 while the first locked part 19 and the second locked part 21 abut on the first abutment part 27, the connector cover body 7 to the first connector constituent 3 in order to join the second terminal 17 to the first terminal 9, the first locked part 19 is first deformed by a reaction force received from the cylindrical part 11 of the first connector constituent 3 and then detached from the first abutment part 27, so that the first locked part 19 is brought into a condition that it can abut on the second abutment part 29. Subsequently, by a reaction force received from the cylindrical part 11 of the first connector constituent 3, the second locked part 21 is deformed and detached from the first abutment part 27. Subsequently, the first locked part 19 abuts on the second abutment part 29. Subsequently, the first locked part 19 and the second locked part 21 are restored, so that the first locked part 19 is locked to the first locking part 13, while the second locked part 21 is locked to the second locking part 15, and additionally, the second terminal 17 is joined to the first terminal 9. For this reason, in the middle of installation of the connector cover body 7 and the second connector constituent 5 in the first connector constituent 3, as illustrated in FIG. 12, the first locked part 19 and the second locked part 21 are prevented from entering a space 45 defined between the first cylindrical part 23 and the second cylindrical part 25 of the connector cover body 7 by mistake.

Additionally, with the connector 1 of the embodiment, the first locked part 19 is composed of the first elastic arm 37, while the second locked part 21 is composed of the second elastic arm 39. When installing the connector cover body 7 and the second connector constituent 5 in the first connector constituent 3, the respective elastic arms 37, 39 are bent and subsequently restored again. For this reason, in the middle of installation of the connector cover body 7 and the second connector constituent 5 in the first connector constituent 3, the connector cover body 7 can be subjected to an appropriate resistance (reaction force in approaching the connector cover body 7 to the first connector constituent 3). Then, when the installation of the connector cover body 7 and the second connector constituent 5 in the first connector constituent 3 has been completed, the above resistance is eliminated substantially. Thus, the connector 1 is constructed so as to facilitate the installation of the connector cover body 7 and the second connector constituent 5 in the first connector constituent 3, and additionally, it is possible to discriminate a state where the installation of the connector cover body 7 and the second connector constituent 5 in the first connector constituent 3 has been completed, easily.

Further, with the connector 1 according to the embodiment, the tip portion 47 of the first elastic arm 37 extends in parallel with the center axis C1 of the connector 1, and additionally, the distance L3 between the center axis C1 and the outer circumferential end of the tip portion 47 of the first elastic arm 37 and the distance L4 between the center axis C1 and the outer circumferential end of the tip portion of the second elastic arm 39 are equal to each other. Thus, the second connector constituent 5 is installed in the connector cover body 7 while the first locked part 19 and the second locked part 21 abut on the first abutment part 27. For this reason, in the state before approaching the connector cover body 7 to the first connector constituent 3 in order to join the second terminal 17 to the first terminal 9, the outer circumferential end of the tip portion 47 of the first elastic arm 37 and the outer circumferential end of the tip portion of the second elastic arm 39 abut on the inner wall of the first cylindrical part 35 of the connector cover body 7, at the site of the notch 49. As a result, even in the state before approaching the connector cover body 7 to the first connector constituent 3, the center axis C1 of the connector cover body 7 will coincide with the center axis C1 of the second connector constituent 5, so that the installation of the connector cover body 7 and the second connector constituent 5 in the first connector constituent 3 is facilitated.

By the way, the connector 1 may be constructed so that, when performing the assembling operation to install the second connector constituent 5 and the connector cover body 7 in the first connector constituent 3 installed in the cylinder head, the assembling operation as described in FIGS. 4 to 11 is performed.

That is, the connector 1 may be constructed as follows.

The connector 1 includes: a first connector constituent including a first terminal and a cylindrical part provided with a first locking part and a second locking part; a second connector constituent provided with a second terminal, a first locked part, and a second locked part; and a connector cover body including a first cylindrical part provided with a first abutment part and a second cylindrical part arranged inside the first cylindrical part coaxially and apart from the first cylindrical part, the second cylindrical part being provided with a second abutment part and constituting a locked-part holding part.

From a condition that the second connector constituent is installed in the connector cover body while the first locked part and the second locked part abut on the first abutment part, it is performed to approach the connector cover body to the first connector constituent in order to join the second terminal to the first terminal. Then, while maintaining the condition that the second locked part is abutting on the first abutment part, the first locked part first abuts on the cylindrical part of the first connector constituent, and then the first locked part is deformed by a reaction force received from the cylindrical part of the first connector constituent and then detached from the first abutment part, so that the first locked part is brought into a condition that it can abut on the second abutment part. Subsequently, while maintaining such a condition that the first locked part is deformed by the reaction force received from the cylindrical part of the first connector constituent and then detached from the first abutment part so that the first locked part is brought into a condition that it can abut on the second abutment part, the second locked part abuts on the cylindrical part of the first connector constituent and then, the second locked part is deformed by the reaction force received from the cylindrical part of the first connector constituent and then detached from the first abutment part. Subsequently, the first locked part abuts on the second abutment part. Subsequently, by the reaction force received from the cylindrical part of the first connector constituent, the second locked part is further deformed to abut on the second abutment part. Subsequently, the first locked part and the second locked part are restored and detached from the second abutment part, so that the first locked part is locked to the first locking part, while the second locked part is locked to the second locking part, and additionally the second terminal is joined to the first terminal. Subsequently, as the second cylindrical part of the connector cover body enters the insides of the cylindrical part of the first connector constituent, the first locked part being locked to the first locking part, and the second locked part being locked to the second locking part, the locked-part holding part maintains the condition that the first locked part is being locked to the first locking part while the second locked part is being locked to the second locking part.

What is claimed is:

1. An electrical connector, comprising:

a first connector constituent including a first terminal, and a cylindrical part provided with a first locking part and a second locking part;

a second connector constituent provided with a second terminal, a first locked part, and a second locked part; and a connector cover body for covering the first connector constituent and the second connector constituent including a first cylindrical part provided with a first abutment part, and a second cylindrical part arranged inside the first cylindrical part and apart from the first cylindrical part, the second cylindrical part provided with a second abutment part and constituting a locked-part holding part, wherein the connector is adapted so that:

when approaching, from a condition that the second connector constituent is installed in the connector cover body while the first locked part and the second locked part abut on the first abutment part, the connector cover body to be connected to the first connector constituent, the first locked part is deformed by a reaction force received from the cylindrical part of the first connector constituent and then detached from the first abutment part, so that the first locked part is brought into a condition that the first locked part can abut on the second abutment part;

subsequently, the second locked part is deformed by the reaction force received from the cylindrical part of the first connector constituent and then detached from the first abutment part, so that the second locked part is brought into a condition that the second locked part can abut on the second abutment part;

subsequently, the first locked part and the second locked part abut on the second abutment part;

subsequently, the first locked part and the second locked part are restored and detached from the second abutment part, so that the first locked part is locked to the first locking part, the second locked part is locked to the second locking part, and the second terminal is joined to the first terminal; and subsequently, the second cylindrical part of the connector cover body enters the insides of the cylindrical part of the first connector constituent, the first locked part being locked to the first locking part, and the second locked part being locked to the second locking part, whereby the locked-part holding part maintains a condition that the first locked part is being locked to the first locking part while the second locked part is being locked to the second locking part.

2. The connector of claim 1, wherein:

the second connector constituent includes a cylindrical part whose outer diameter is somewhat smaller than an inner diameter of the cylindrical part of the first connector constituent;

the first locked part includes a first elastic arm which is elongated so as to project from an outer circumference of the cylindrical part obliquely to a generatrix of the outer circumference of the cylindrical part;

the second locked part includes a second elastic arm which is elongated so as to project from the outer circumference of the cylindrical part obliquely to the generatrix of the outer circumference of the cylindrical part; and a crossing angle of the first elastic arm to the generatrix of the outer circumference of the cylindrical part is larger than a crossing angle of the second elastic arm to the generatrix of the outer circumference of the cylindrical part.

3. The connector of claim 2, wherein:

the first elastic arm includes a tip portion extending in parallel with a center axis of the cylindrical part of the second connector constituent;

a distance between the center axis of the cylindrical part of the second connector constituent and an outer circumferential end of the tip portion of the first elastic arm and a distance between the center axis of the cylindrical part of the second connector constituent and an outer circumferential end of the tip portion of the second elastic arm are equal to each other; and in a state before approaching the connector cover body to the first connector constituent in a situation where the second connector constituent is installed in the connector cover body while the first locked part and the second locked part abut on the first abutment part, the outer circumferential end of the tip portion of the first elastic arm and the outer circumferential end of the tip portion of the second elastic arm abut on an inner wall of the first cylindrical part of the connector cover body.

4. An electrical connector, comprising:

a first connector constituent including a first terminal, and a cylindrical part provided with a first locking part and a second locking part;

a second connector constituent provided with a second terminal, a first locked part, and a second locked part; and a connector cover body for covering the first connector constituent and the second connector constituent including a first cylindrical part provided with a first abutment part, and a second cylindrical part arranged inside the first cylindrical part and apart from the first cylindrical part, the second cylindrical part provided with a second abutment part and constituting a locked-part holding part, wherein the connector is adapted so that:

when approaching, from a condition that the second connector constituent is installed in the connector cover body while the first locked part and the second locked part abut on the first abutment part, the connector cover body to be connected to the first connector constituent, the first locked part is deformed by a reaction force received from the cylindrical part of the first connector constituent and then detached from the first abutment part, so that the first locked part is brought into a condition that the first locked part can abut on the second abutment part;

subsequently, the second locked part is deformed by the reaction force received from the cylindrical part of the first connector constituent and then detached from the first abutment part;

subsequently, the first locked part abuts on the second abutment part;

subsequently, the first locked part and the second locked part are restored and detached from the second abutment part, so that the first locked part is locked to the first locking part, the second locked part is locked to the second locking part, and the second terminal is joined to the first terminal; and subsequently, the second cylindrical part of the connector cover body enters the insides of the cylindrical part of the first connector constituent, the first locked part being locked to the first locking part, and the second locked part being locked to the second locking part, whereby the locked-part holding part maintains a condition that the first locked part is being locked to the first locking part while the second locked part is being locked to the second locking part.

5. The connector of claim 4, wherein:

the second connector constituent includes a cylindrical part whose outer diameter is somewhat smaller than an inner diameter of the cylindrical part of the first connector constituent;

the first locked part includes a first elastic arm which is elongated so as to project from an outer circumference of the cylindrical part obliquely to a generatrix of the outer circumference of the cylindrical part;

the second locked part includes a second elastic arm which is elongated so as to project from the outer circumference of the cylindrical part obliquely to the generatrix of the outer circumference of the cylindrical part; and a crossing angle of the first elastic arm to the generatrix of the outer circumference of the cylindrical part is larger than a crossing angle of the second elastic arm to the generatrix of the outer circumference of the cylindrical part.

6. The connector of claim 5, wherein:

the first elastic arm includes a tip portion extending in parallel with a center axis of the cylindrical part of the second connector constituent;

a distance between the center axis of the cylindrical part of the second connector constituent and an outer circumferential end of the tip portion of the first elastic arm and a distance between the center axis of the cylindrical part of the second connector constituent and an outer circumferential end of the tip portion of the second elastic arm are equal to each other; and in a state before approaching the connector cover body to the first connector constituent in a situation where the second connector constituent is installed in the connector cover body while the first locked part and the second locked part abut on the first abutment part, the outer circumferential end of the tip portion of the first elastic arm and the outer circumferential end of the tip portion of the second elastic arm abut on an inner wall of the first cylindrical part of the connector cover body.

* * * * *